US012752964B1

(12) United States Patent
Gross et al.

(10) Patent No.: US 12,752,964 B1
(45) Date of Patent: Oct. 6, 2026

(54) STANDING TOTE WITH STACKING OR SLIDING LID

(71) Applicant: Packit, LLC, Agoura Hills, CA (US)

(72) Inventors: Kenneth Arthur Gross, Porter Ranch, CA (US); Roland Ecarma, Northridge, CA (US)

(73) Assignee: Packit, LLC, Agoura Hills, CA (US)

( * ) Notice: Subject to any disclaimer, the term of this patent is extended or adjusted under 35 U.S.C. 154(b) by 525 days.

(21) Appl. No.: 18/136,240

(22) Filed: Apr. 18, 2023

Related U.S. Application Data

(60) Provisional application No. 63/332,091, filed on Apr. 18, 2022.

(51) Int. Cl.

| | |
|---|---|
| ***B65D 6/18*** | (2006.01) |
| ***B65D 81/38*** | (2006.01) |
| ***F25D 3/08*** | (2006.01) |
| *B65D 43/02* | (2006.01) |

(52) U.S. Cl.
CPC ..... *B65D 11/184* (2013.01); *B65D 81/3823* (2013.01); *F25D 3/08* (2013.01); *B65D 43/0214* (2013.01)

(58) Field of Classification Search
CPC .. A45C 11/20; B65D 11/184; B65D 81/3823; B65D 81/3811; B65D 81/38; B65D 81/3888; B65D 43/0214; B65D 43/22; B65D 43/16; B65D 25/2882; B65D 25/2885; B65D 25/2888; F25D 3/08; F25D 3/06; F25D 3/02
USPC ..... 220/9.2, 230, 754, 752, 592.03, 592.22, 220/324, 315, 592.26, 592.2, 592.09; 62/457.4, 157.2, 457.7, 457.9
See application file for complete search history.

(56) References Cited

U.S. PATENT DOCUMENTS

| | | | | |
|---|---|---|---|---|
| 9,809,376 | B2 * | 11/2017 | Mitchell | A45F 3/02 |
| 2003/0106895 | A1 * | 6/2003 | Kalal | B65D 21/086 220/9.2 |
| 2003/0136702 | A1 * | 7/2003 | Redzisz | A45C 7/0077 206/545 |
| 2020/0109889 | A1 * | 4/2020 | Kieling | F25D 3/08 |

* cited by examiner

*Primary Examiner* — Jeffrey R Allen
*Assistant Examiner* — Elizabeth J Volz
(74) *Attorney, Agent, or Firm* — Vedder Price P.C.

(57) ABSTRACT

The present disclosure generally relates to devices and methods for transporting and storing food items, and more specifically relate to storage totes with a top panel for use in delivering temperature-controlled items such as perishable food. Embodiments of the storage tote and top panel include top panels comprising a slide lid, a foldable lid, a detachable lid, a flip lid, or combinations thereof.

18 Claims, 24 Drawing Sheets

STANDING TOTE WITH STACKING OR SLIDING LID

CROSS REFERENCE TO OTHER APPLICATION

This application claims the benefit of a priority to U.S. Provisional Application No. 63/332,091 filed Apr. 18, 2022, the contents of which are incorporated by reference herein in their entireties.

FIELD OF THE DISCLOSURE

The present disclosure generally relates to devices and methods for transporting items, and more specifically relates to standing totes with top panels comprising a slide lid, a foldable lid, a detachable lid, a flip lid, or combinations thereof for use in storing and delivering temperature-controlled items such as perishable food.

BACKGROUND

Multipurpose rigid and semi-rigid containers and coverings are commonly used for packing, storing, transporting, and insulating items, particularly those such as food, beverages, and other items that need to be kept warm or cool for a significant period of time during storage or transport. Existing products suffer from a number of drawbacks.

Many existing rigid and semi-rigid containers either are not stackable or rely on cooling media that are not suitable for use for longer periods of time while transporting or storing items, particularly within the delivery context. By way of example, larger picnic-style coolers with rigid walls are generally filled with ice, which melts and can make the contents of such coolers wet. This renders the coolers unsuitable for use with certain types of items, such as food. The ice is also bulky and takes up a significant amount of space in the cooler in order to provide adequate cooling.

Alternatively, some containers place a cooling media (such as gel packs) in the lining of the container walls. However, such existing containers are typically bulky and take up a relatively large amount of space in a freezer when cooling and either are not stackable or otherwise are not amenable to being stored in a nested formation when not in use. Other containers are known which contain gel material in the walls for cooling or heating purposes, but these are also bulky and difficult or impossible to fold into a compact condition, and they may be difficult to heat (or chill).

The drawbacks of these containers are compounded when the containers are scaled to a larger size. For example, in the context of delivery, where there is a need for containers of various sizes and an efficient means of storage and transport, containers that are large enough to accommodate larger loads are particularly bulky and difficult to store and transport. Further, when temperature-controlled items, such as perishable foods, are transported or stored in a container that is regularly opened, the insulating benefits of a container are diminished. For example, when perishable foods are stored in containers which are stacked on top of each other, it may be necessary to remove the entire container from the stack and to open the entire lid to retrieve the desired items from within. This process wastes the stored refrigerated air within the container and is inconvenient to the user.

Finally, many existing containers do not remain upright while empty, particularly while allowing access to the container's interior (as is necessary to insert or remove items).

SUMMARY

A need exists for improved devices for storing and transporting items, particularly those items that must be maintained in a temperature-controlled environment, and which may need to be placed in stacked configuration and easily accessed. The devices and related methods described in the present disclosure address the drawbacks of existing designs.

Embodiments disclosed provide improvements to storage totes and lids which allow for improved transportation and stacking of the containers. In particular, the disclosed embodiments provide storage totes with top panels comprising of lids (or movable panels) which make the storage containers more secure, aid in the case of stacking multiple containers, prevent the containers from unintentionally collapsing when stacked, transported, or stored, and increase the efficiency and ease by which an item can be removed from the storage container. The disclosed embodiments further provide storage totes that are configured to fold into a collapsed configuration by removing the top panel, folding the front panel and rear panels into the interior cavity along one or more fold lines, and folding the side panels inward. The collapsible nature of the storage totes along with the various embodiments of top panels with manipulatable lids allow the totes to more easily be placed in freezers and refrigerators. The top panels with lids that can be easily opened and closed further allow for more rapid chilling of the containers as cold air more rapidly and easily enters the base of the container and chills the gel packs and other temperature control layers that make up the walls and panels of the tote.

An embodiment, a storage tote with lid comprising: a base panel; a front wall extending from the base panel; a rear wall extending from the base panel opposite the front wall; a pair of opposing side walls extending from the base panel between the front wall, the rear wall, and a top panel, wherein the base panel, the front wall, the rear wall, and the pair of opposite side walls define a cavity therebetween, wherein the top panel further comprises a slide lid and may further comprise a gusset and/or lid apron. The slide lid may be moved by means of a strap. The slide lid may be opened by means of sliding the lid into a pocket in the top panel. The slide lid may be secured to the top panel by means of a fastening strap, magnet, hooks and loops, or a receiving pocket.

An embodiment provides a tote with lid comprising: a base panel; a front wall extending from the base panel; a rear wall extending from the base panel opposite the front wall; a pair of opposing side walls extending from the base panel between the front wall, the rear wall, and a top panel, wherein the base panel, the front wall, the rear wall, and the pair of opposite side walls define a cavity therebetween, wherein the top panel further comprises a flip lid and may further comprise a gusset and/or lid apron. The flip lid may be opened by means of a strap. The flip lid is secured to the top panel by means of a fastening strap, magnet, or hooks and loops, or another fastening mechanism as understood by one of skill in the art.

An embodiment provides a tote with lid comprising: a base panel; a front wall extending from the base panel; a rear wall extending from the base panel opposite the front wall; a pair of opposing side walls extending from the base panel between the front wall, the rear wall, and a top panel with lid, wherein the base panel, the front wall, the rear wall, and the pair of opposite side walls define a cavity therebetween, wherein the top panel comprises a lid, and which may be removeable from the tote or connected to the tote on one edge, and which may be secured to the tote base with a fastener strap, magnets, or hooks and loops, and which the tote base may further have a gusset.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION

Figure 1:
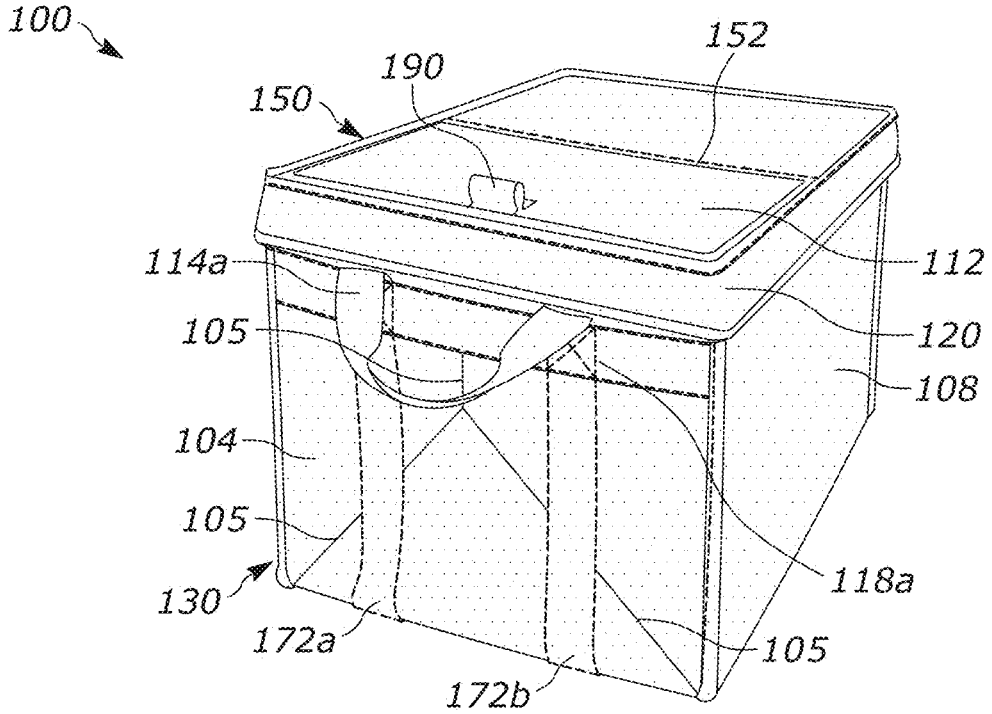
FIG. 1 is a front quarter view of a first embodiment of a tote in accordance with the present disclosure comprising a top panel with a slide lid, lid apron, and pull tab strap to open the slide lid.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one of skill in the art to which this disclosure relates. Except as otherwise noted, features disclosed as being present in one embodiment are contemplated as being able to be incorporated into other embodiments disclosed herein without departing from the spirit of this disclosure.

Tote and Lid, Generally

The present disclosure contemplates various configurations of tote containers having a tote base 130 and top panel 150. The present disclosure further contemplates a plurality of lids 112 that may comprise the top panel 150. Lids 112 can be mixed and matched with top panels 150 and totes 100 such that each lid 112 may be used with each embodiment of a tote 100 disclosed herein.

FIG. 1 depicts a general embodiment of a tote container 100. The tote 100 generally comprises a rectangular structure having a base panel 102 (not shown), a front wall 104, a rear wall 106 (not shown), opposite side walls 108, 110 (not shown), and a top panel 150, which together define a cavity which receives items to be transported or stored. Generally, the tote 100 may be stacked on other totes 100 as the disclosed tote and top panel embodiments reduce the likelihood that the totes 100 will collapse.

Generally, a pair of handles 114*a*, 114*b* (not shown) are attached to the front wall 104 and the rear wall 106, respectively.

As shown in FIG. 1, the tote 100 generally has a first horizontal strap 118*a* on the front wall 104, a second horizontal strap 118*b* (not shown) on the rear wall 106 (not shown). The first horizontal strap 118*a* is generally on the front wall panel 104, while the second horizontal strap 118*b* is generally on the back panel 106. Generally, the tote 100 has two vertical straps 172*a*, 172*b* each on the front wall 104 and rear wall 106. In addition, the front wall 104, rear wall 106, and base panel 102 may comprise fold lines 105 which allow users to collapse the tote 100 by folding the front panel 104 and rear panel 106 into the interior cavity along one or more fold lines 105, and folding the side panels 108, 110 inward.

Figure 2:
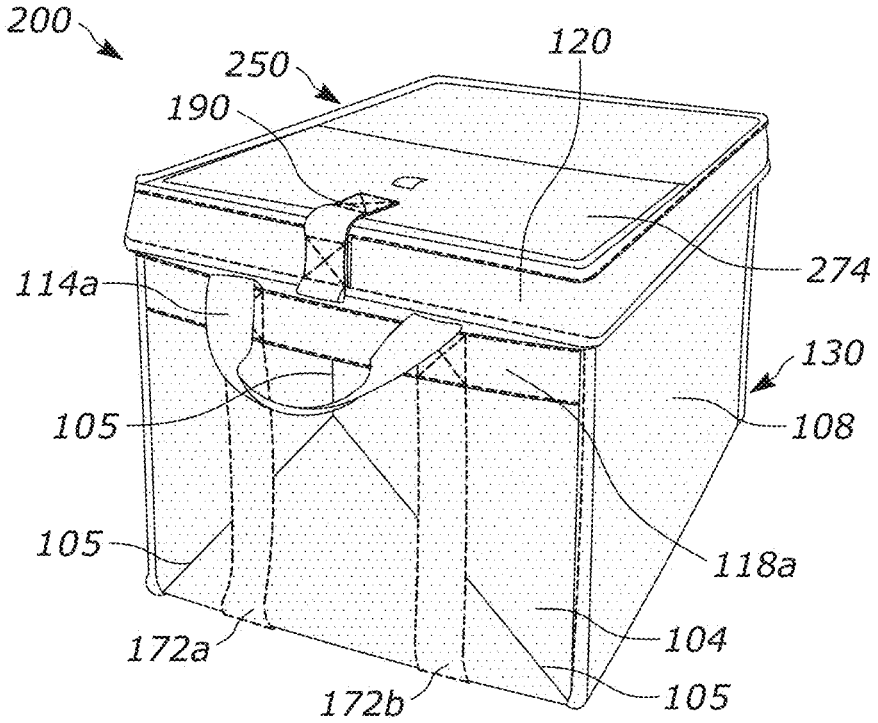
FIG. 2 is a front quarter view of a second embodiment of a tote in accordance with the present disclosure comprising a top panel with a flip lid, lid apron, and hook and strap fastener to secure the flip lid in a closed position.

In some embodiments a strap 190 is connected to one side of the top panel 150. The strap 190 may be a single piece of webbing (as shown in FIG. 2) or a loop (as shown in FIG. 1). This strap 190 aids in the opening of a portion of the top panel 150. In some embodiments, the strap 190 may be secured to the top panel 150 with hardware 180 such as magnets or hooks and loops or other means as would be understood by one of ordinary skill in the art. The strap 190 on the slide lid 112 further aids a user when the tote 100 is in a stacked configuration. A user may pull on the handle 114*a* of the front panel 104 to move the tote 100 partially out of a stacked configuration, but without the need to fully remove the entire tote 100. When the tote 100 is partially removed from a stacked configuration, a user may open the tote 100 by means of pulling the strap 190 on the slide lid 112 which only opens a portion of the top panel 150. In this manner the temperature within the tote 100 is conserved.

Figure 35:
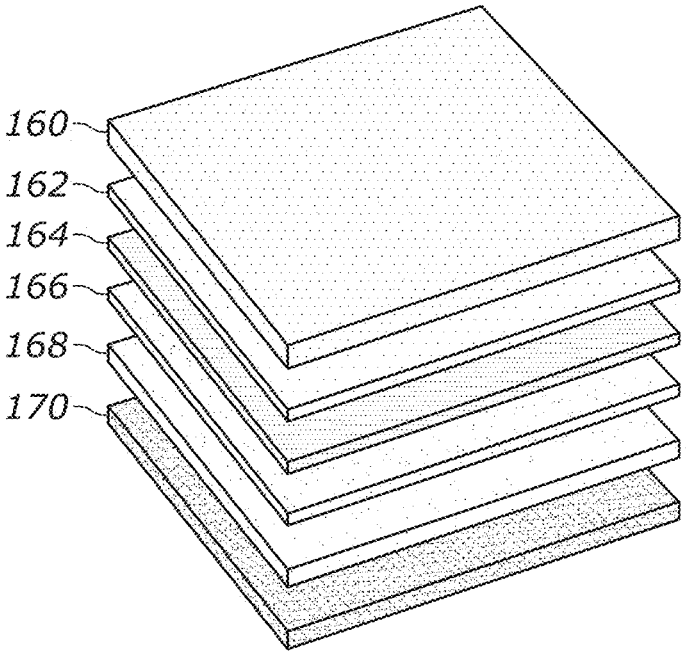
FIG. 35 depicts a cross-section of the interior structure of one or more walls or panels of the thirteenth embodiment shown in FIG. 29, illustrating a plurality of layers that comprise the wall or panel.
Figure 36:
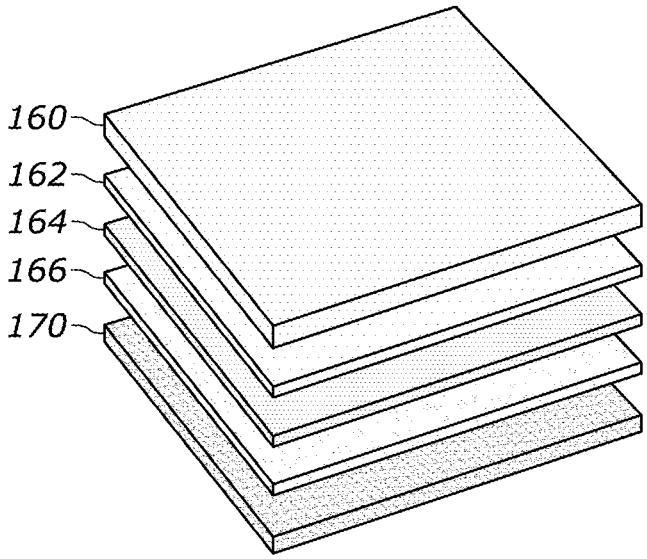
FIG. 36 depicts a cross-section of the interior structure of one or more walls or panels of the thirteenth embodiment shown in FIG. 29, illustrating a plurality of layers that comprise the wall or panel.

Generally, the tote 100 is temperature-controlled so as to maintain the temperature of the items stored or transported within the tote container 100. FIGS. 35 and 36 depict a non-limiting cross-sectional illustration of the interior structure of one or more of the tote walls or panels comprising a plurality of temperature control layers (not shown to scale).

FIGS. 35 and 36 illustrate a plurality of layers including one or more of a first exterior layer 160, a second interior layer 162, a third interior layer 164, a fourth interior layer 166, a fifth interior layer 168, and a sixth interior layer 170 that may comprise one or more of the tote walls and panels. In an alternative embodiment other configurations can be used.

Figure 39:
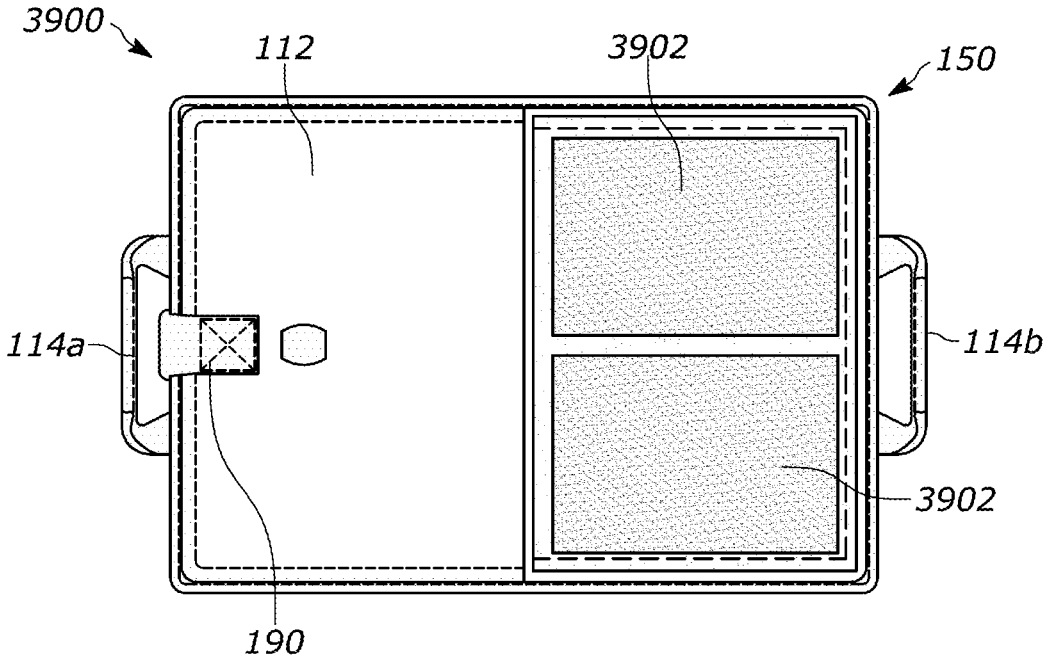
FIG. 39 depicts a top view of the interior structure of a portion of the top panel of the thirteenth embodiment shown in FIG. 29, illustrating the locations of gel packs in the top panel of the tote.
Figure 41:
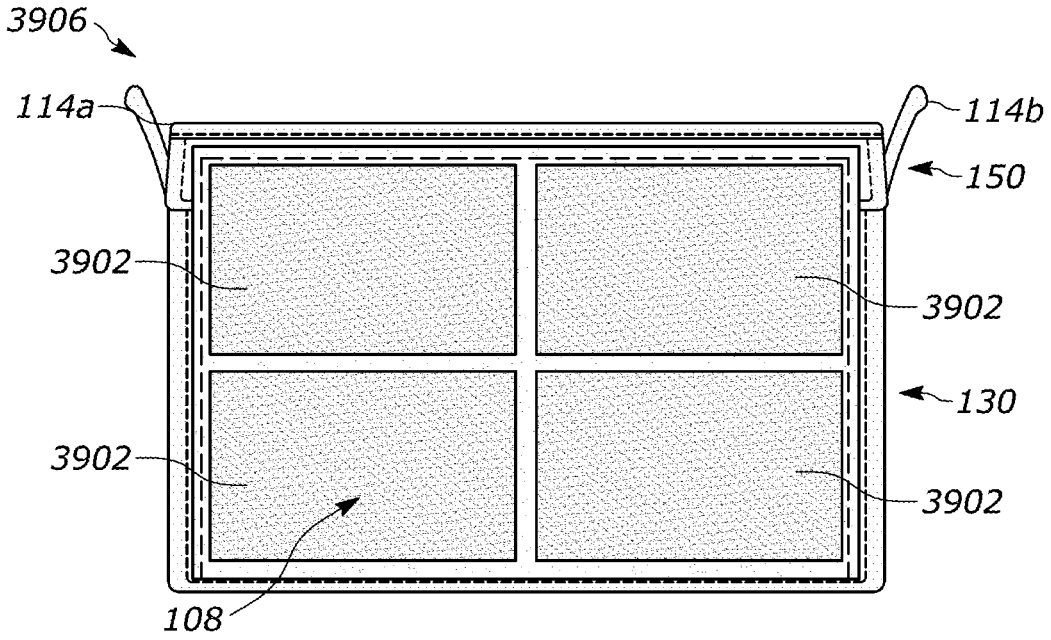
FIG. 41 depicts a left side view of the interior structure of one or more side walls of the embodiment shown in FIG. 29, illustrating the locations of gel packs in one or more side walls of the tote.

The first exterior layer 160 comprises a protective, relatively strong and durable synthetic or natural material such as fabric, canvas, nylon, coated polyester, or the like. In an embodiment, the first exterior layer 160 includes an aluminizing material or coating to better reflect and disperse radiation (such as heat) away from the tote container 100. In some embodiments, the second interior layer 162 is comprised of Radiant Shield™. In other embodiments, the second interior layer 162 is comprised of an aluminum radiant barrier reinforced with woven polyethylene. The third interior layer 164 comprises a rigid or semi-rigid material, such as polyethylene (PE) board or PE-coated paperboard, board to provide support for the tote 100. In some embodiments, a layer of high-density polyethylene (HDPE) foam may act as a third interior layer 164. The fourth interior layer 166 comprises a material for maintaining the temperature of the cavity of the tote container 100 and any items located therein (e.g., by either cooling or heating). In some embodiments the fourth interior layer 166 comprises insulation, such as cotton insulation, an insulating foam, a rigid or semi-rigid polyurethane foam, a soft polyurethane foam, or a high-density polyethylene (HDPE) foam. In an embodiment, the fourth interior layer 166 comprises a layer of insulation that is approximately 7 millimeters thick. As shown in FIGS. 39 and 41, in an embodiment, the fifth interior layer 168 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. The sixth interior layer 170 comprises a waterproof material, such as polyethylene vinyl acetate (PEVA), or a plastic foil material. As will be clear to one of skill in the art from the present disclosure, in alternative embodiments, the structure of the tote 100 walls or panels may be varied to either include additional layers (such as by including additional layers of insulation) or omit layers (such as gel packs when not required).

Figure 43:
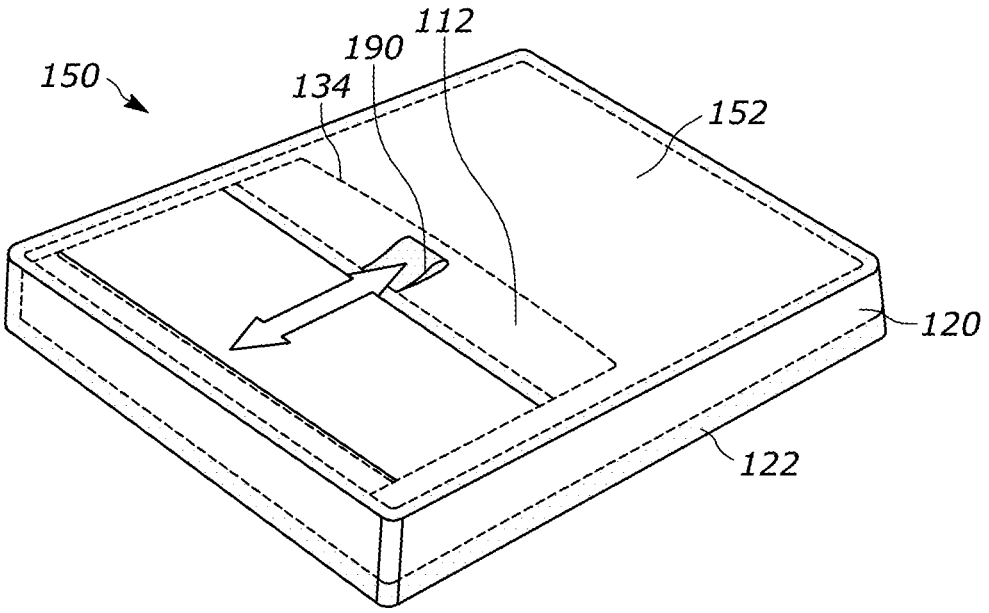
FIG. 43 depicts a top view of an alternative top panel that can be used in place of the top panel in the thirteenth embodiment shown in FIG. 29, the top panel comprising a slide lid, lid apron with reinforcements, gusset, pocket and opening with the slide lid depicted in a partially open position.
Figure 44:
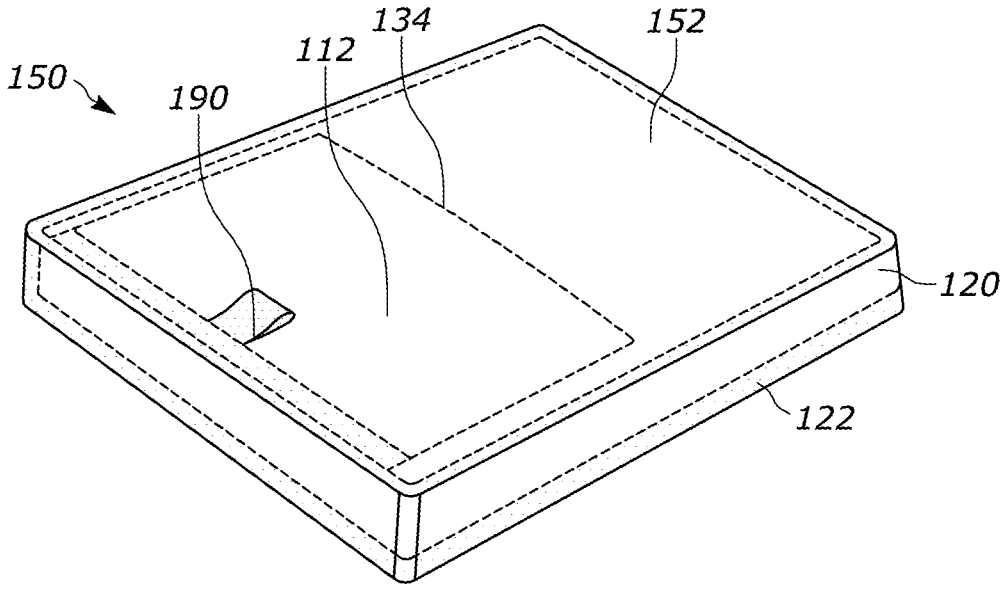
FIG. 44 depicts the embodiment of FIG. 43 with the slide lid depicted in a fully closed position.

In some embodiments the top panel 150 may further comprise a lid apron 120. The lid apron 120 may increase the surface area of the contract surface thereby improving the heat or cold retention of the tote 100. The lid apron 120 may also include reinforcements 122 (as depicted in FIGS. 43-44), providing for added rigidity to the top panel and further easing storage of the totes.

In some embodiments a mylar sheet (not shown) can be added underneath the first exterior layer 160 of EVA/PU 600D poly; in these embodiments the additional mylar layer will not be added to any apron 120 lids. Instead, a double layer of the first exterior layer 160 material will be added to the apron lid 120.

Figure 29:
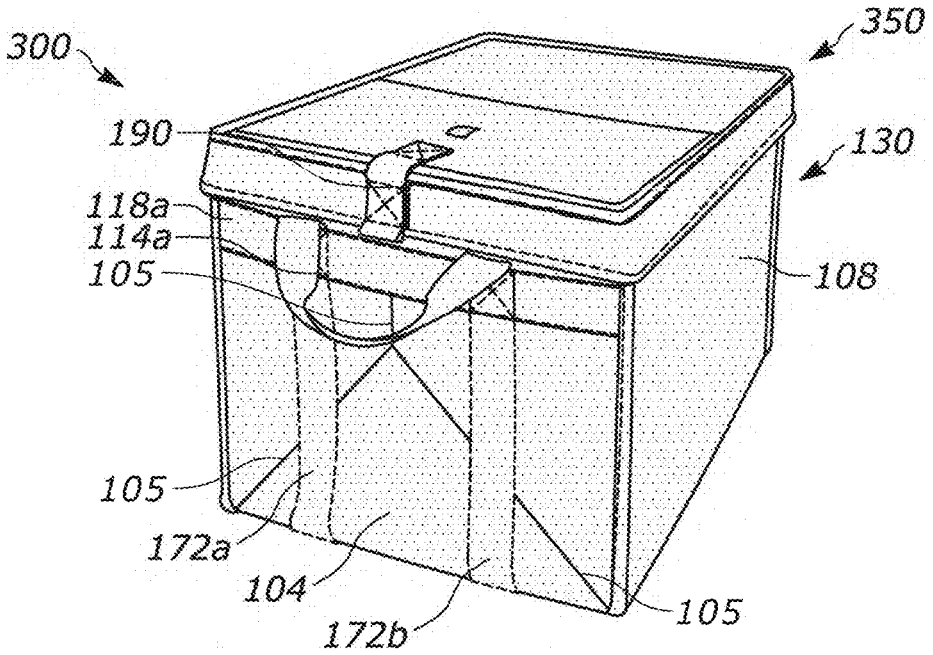
FIG. 29 depicts the thirteenth embodiment shown in FIG. 27 wherein the folding lid is configured to be in a fully closed position.
Figure 30:
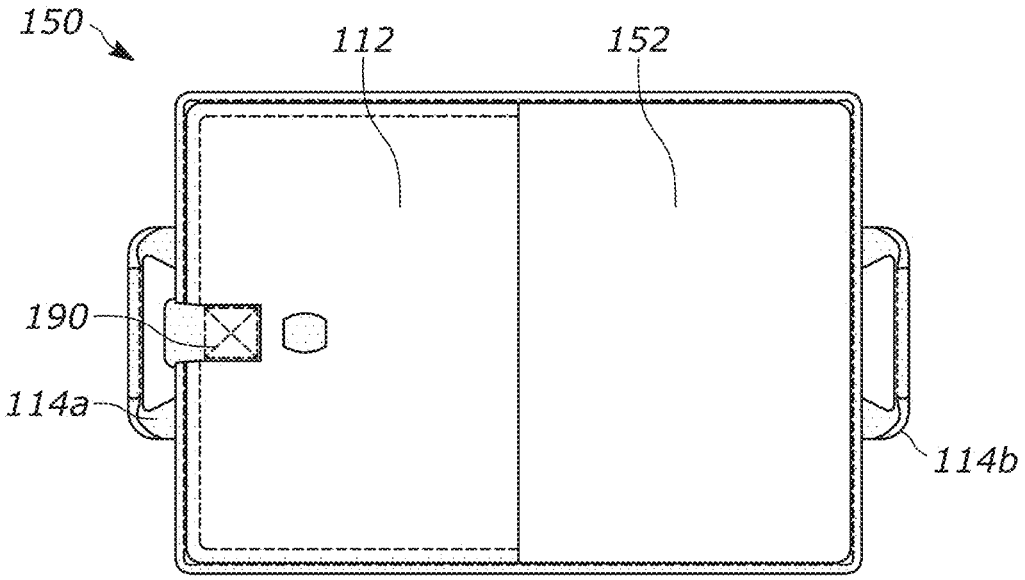
FIG. 30 is a top view of the thirteenth embodiment shown in FIG. 29.
Figure 31:
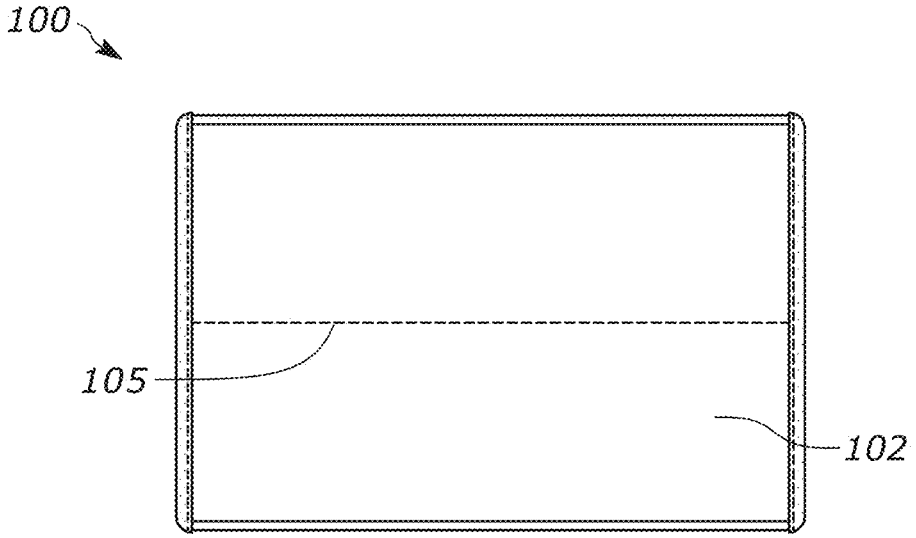
FIG. 31 is a bottom view of the thirteenth embodiment shown in FIG. 29.
Figure 32:
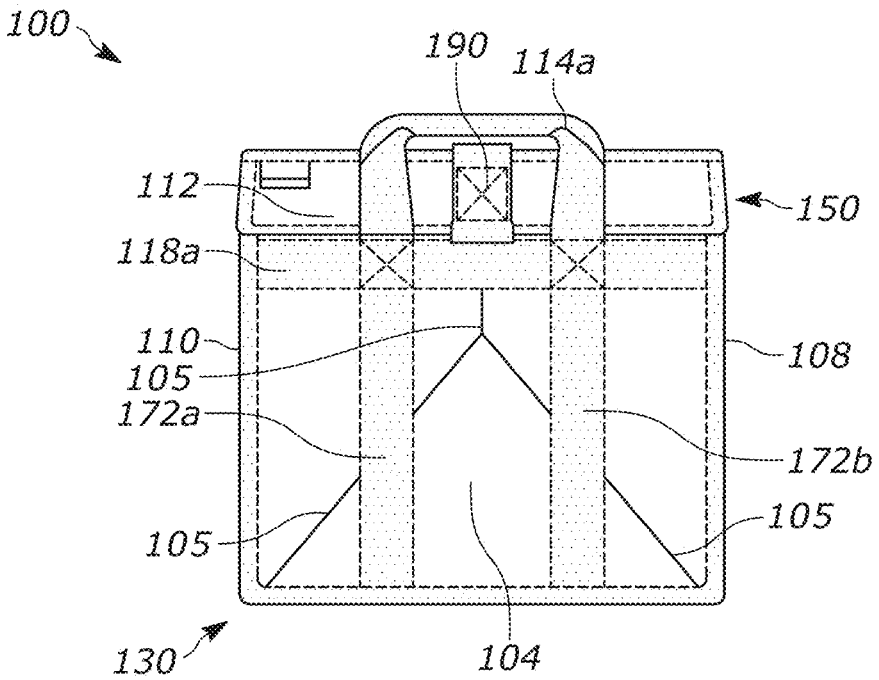
FIG. 32 is a front view of the thirteenth embodiment shown in FIG. 29.
Figure 33:
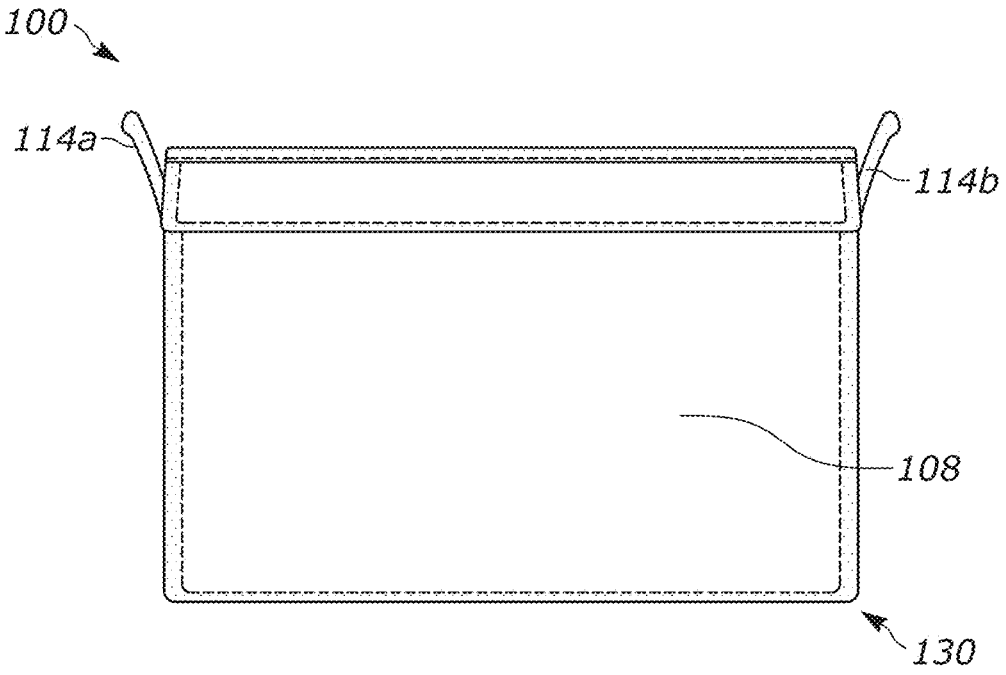
FIG. 33 is a side view of the thirteenth embodiment shown in FIG. 29.
Figure 34:
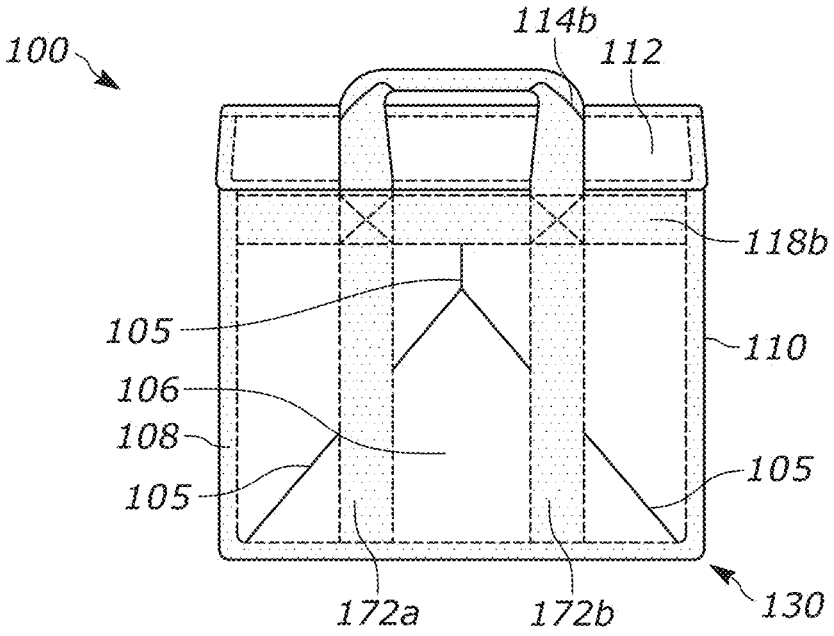
FIG. 34 is a rear view of the thirteenth embodiment shown in FIG. 29.
Figure 37:
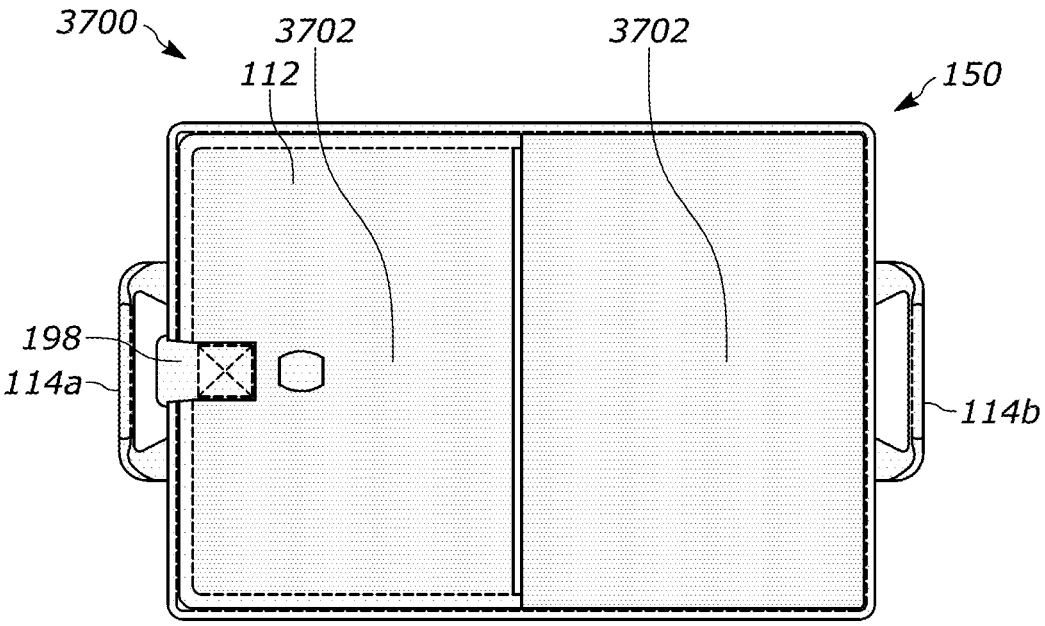
FIG. 37 depicts a top view of the interior structure of the top panel of the thirteenth embodiment shown in FIG. 29, illustrating the locations of stiffeners in the top panel of the tote.
Figure 38:
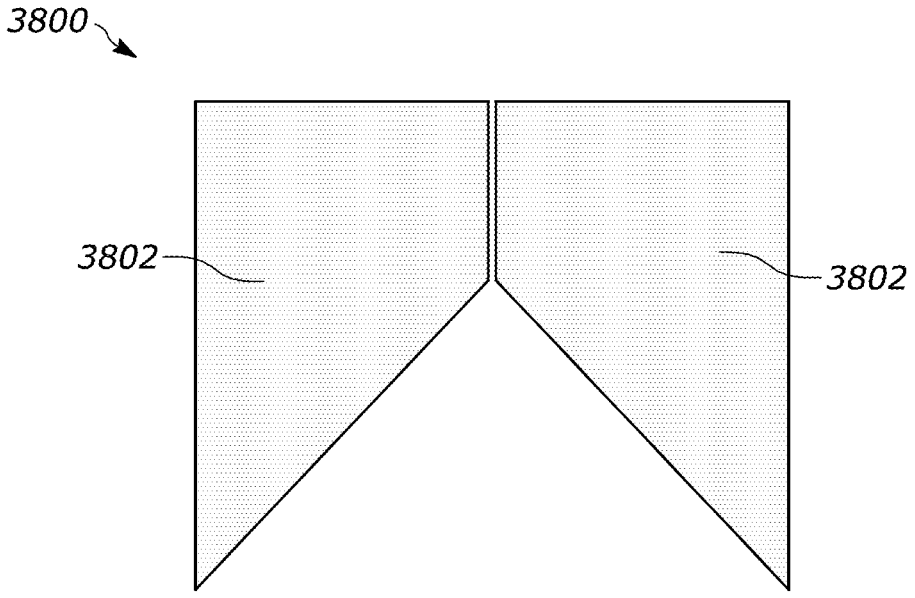
FIG. 38 depicts a front view of the interior structure of the front or rear panel of the thirteenth embodiment shown in FIG. 29, illustrating the locations of stiffeners in the front or rear panels of the tote.

In some embodiments, stiffeners may be utilized to provide stiffening and rigidity to the tote 100 to ease storage and stacking. FIG. 37 depicts a top view of the embodiment of FIG. 29, illustrating the locations of a plurality of stiffeners 3702 in the top panel 150 of the tote 3700. FIG. 38 depicts a front view and a back view of the embodiment of FIG. 29, illustrating the locations of the plurality of stiffeners 3802 in the front and back panels of the tote 3800. The stiffeners 3802 are so placed in the upper right and left hand portions of the front panel 104 (not shown), such that when the tote 3800 is folded along the fold lines 105, the bottom portion of the front panel 104 (not shown) easily collapses into the cavity of the base 130 (not shown).

Figure 40:
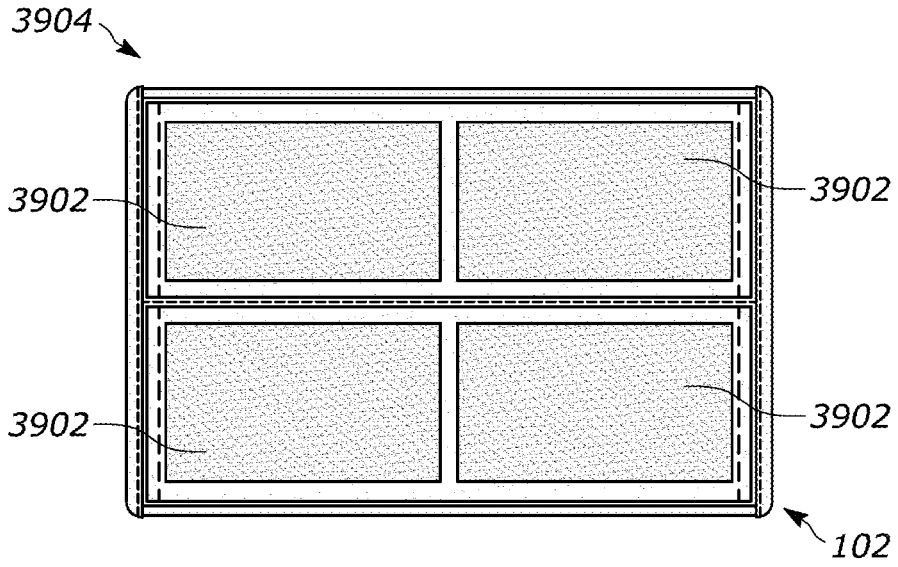
FIG. 40 depicts a bottom view of the interior structure of the bottom panel of the thirteenth embodiment shown in FIG. 29, illustrating the locations of gel packs in the bottom panel of the tote.

As depicted in FIGS. 38-41, the temperature control layer comprising gel packs 3902 are placed in one or more portions of the walls or panels of the tote 100. FIG. 39 depicts a top view of the interior structure of a tote 3904 wherein a portion of the top panel 150 comprises a temperature control layer with a plurality of gel packs 3902. FIG. 40 depicts a bottom view of the interior structure of a tote 3904 wherein the base panel 102 comprises a temperature control layer with a plurality of gel packs 3902. FIG. 41 depicts a right side view of the interior structure of a tote 3906 wherein the side wall 108 comprises a temperature control layer with a plurality of gel packs 3902.

In some embodiments of the tote 100 a gusset 124 may be used to secure the top panel 150 to the base 130. The gusset 124 extends around all sides of the top of the base 130 and along the topmost portion of the front wall 104, the side walls 108, 110, and the rear wall 106. Hardware 180 may be used to secure the top panel 150 to the gusset 124, thereby retaining heat or cold within the tote 100.

Generally, the tote 100 depicted in FIG. 1 will have a height of approximately 35 cm, a width of approximately 34 cm, and a depth of approximately 54 cm. Generally, the sliding lid 112, will have a width of approximately 32 cm, a length of approximately 29 cm. The gusset 124 will generally extend 5 cm from the front wall 104, and 4 cm from each side wall 108, 110. The top panel will generally be 54 cm in length, 39 cm in width, so that approximately 27 cm of space exists as the opening into the tote 100.

Tote with Slide Lid

FIG. 1 depicts a tote 100 with a slide lid embodiment. In this embodiment, the top panel 150 comprises a moveable slide lid 112. The slide lid 112 is moved by means of a handle loop 190, or other means as would be known by one of ordinary skill in the art. Various embodiments of the slide lid are further depicted in FIGS. 15-26, and 42-44.

Figure 15:
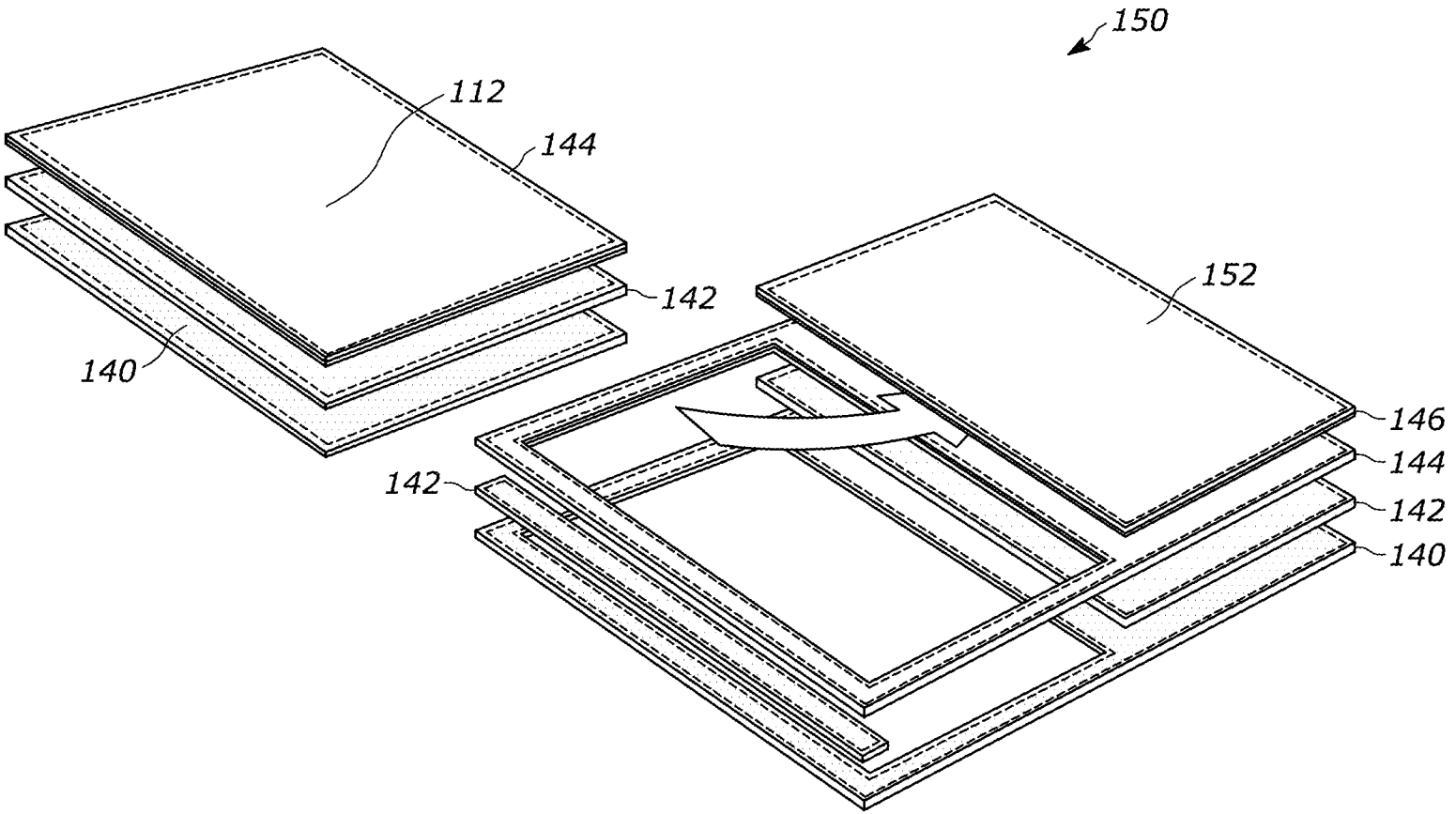
FIG. 15 illustrates an exploded top quarter view of a first embodiment of a top panel comprising a slide lid in accordance with the present disclosure illustrating a plurality of layers and a pocket configured to hold the slide lid in a stored position.

As depicted in connection with the embodiments shown in FIGS. 15-26, and 42-44, the slide lid 112 may be movable and slid into a lid pocket 152 on the top panel 150 through the opening 132. As depicted in FIG. 15 the top panel 150 and slide lid 112 may be comprised of a plurality of layers which are secured together by stitching. The top panel comprises a first layer 140, a second layer 142, a third layer 144, and a fourth layer 146. The pocket 152 is comprised of the fourth layer 146. The first layer 140, the third layer 144, and the fourth layer 146 may be made of the same material. The second layer may comprise a stiffener. Similarly the slide lid 112 comprises a first layer 140, a second layer 142, and a third layer 144. When the slide lid 112 is in a fully closed position the layers of the slide lid 112 align with the layers of the top panel. When the slide lid 112 is in a fully open position the slide lid 112 is housed within the pocket 152.

Figure 16:
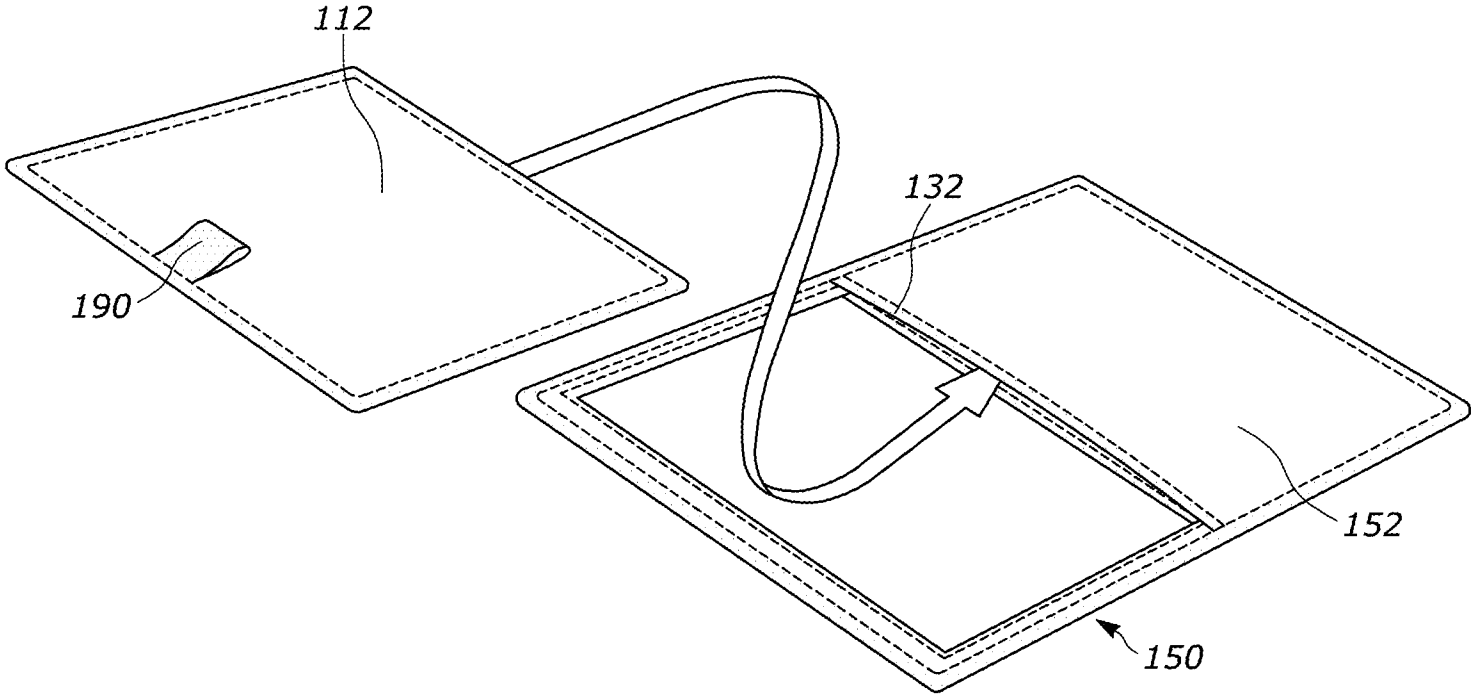
FIG. 16 is a top quarter view of a second embodiment of a top panel in accordance with the present disclosure comprising a removable slide lid, illustrating the slide lid removed from the top panel and a pocket configured to hold the slide lid in a stored position.
Figure 17:
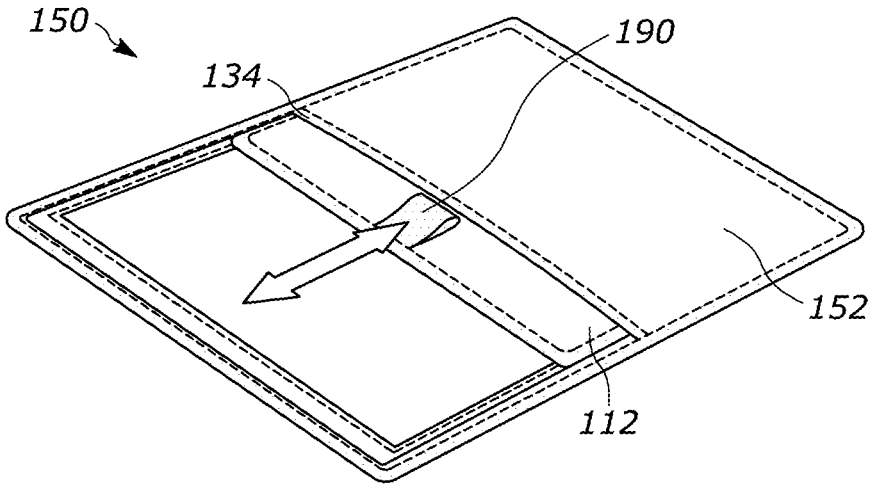
FIG. 17 is a top quarter view of the second embodiment of FIG. 16 with the slide lid moving from an open position to a closed position.
Figure 18:
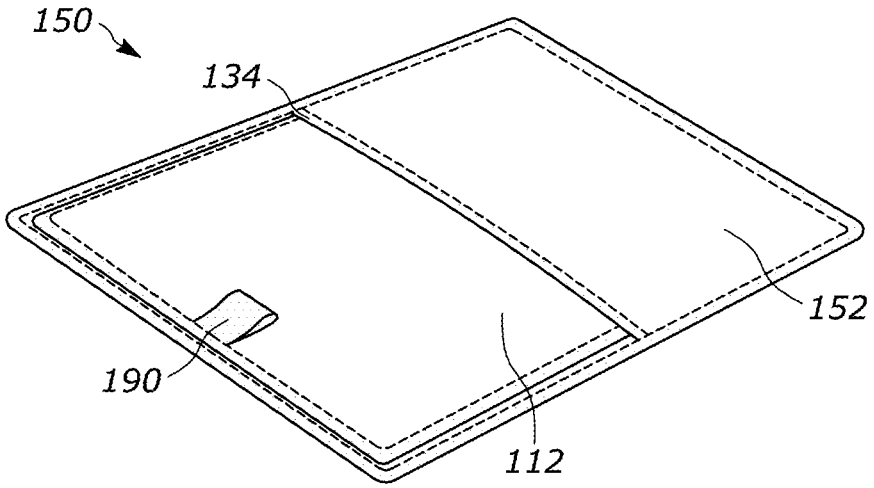
FIG. 18 is a top quarter view of the second embodiment of FIG. 16 with the slide lid in a closed position wherein the slide lid fully covers the gusset.

In some embodiments, the slide lid 112 is fully removable (as depicted by FIG. 16). In some further embodiments, the slide lid 112 is not fully removable (as depicted by FIGS. 17-26).

In some embodiments, the top panel 150 with slide lid 112 will not have a lid apron 120 (as depicted by FIGS. 16-26).

In embodiments, the slide lid 112 comprises gussets 154 (as depicted, for example, in FIGS. 21-26). Gussets 154 may be inner gussets (i.e., which are located below the slide lid), outer gussets (i.e., which are located above the slide lid), or combination gussets which feature both an inner gusset and an outer gusset with the slide lid located therebetween.

In some embodiments the top panel 150 is secured to the base 130 by means of hardware 180 attached to the gusset 124.

Figure 42:
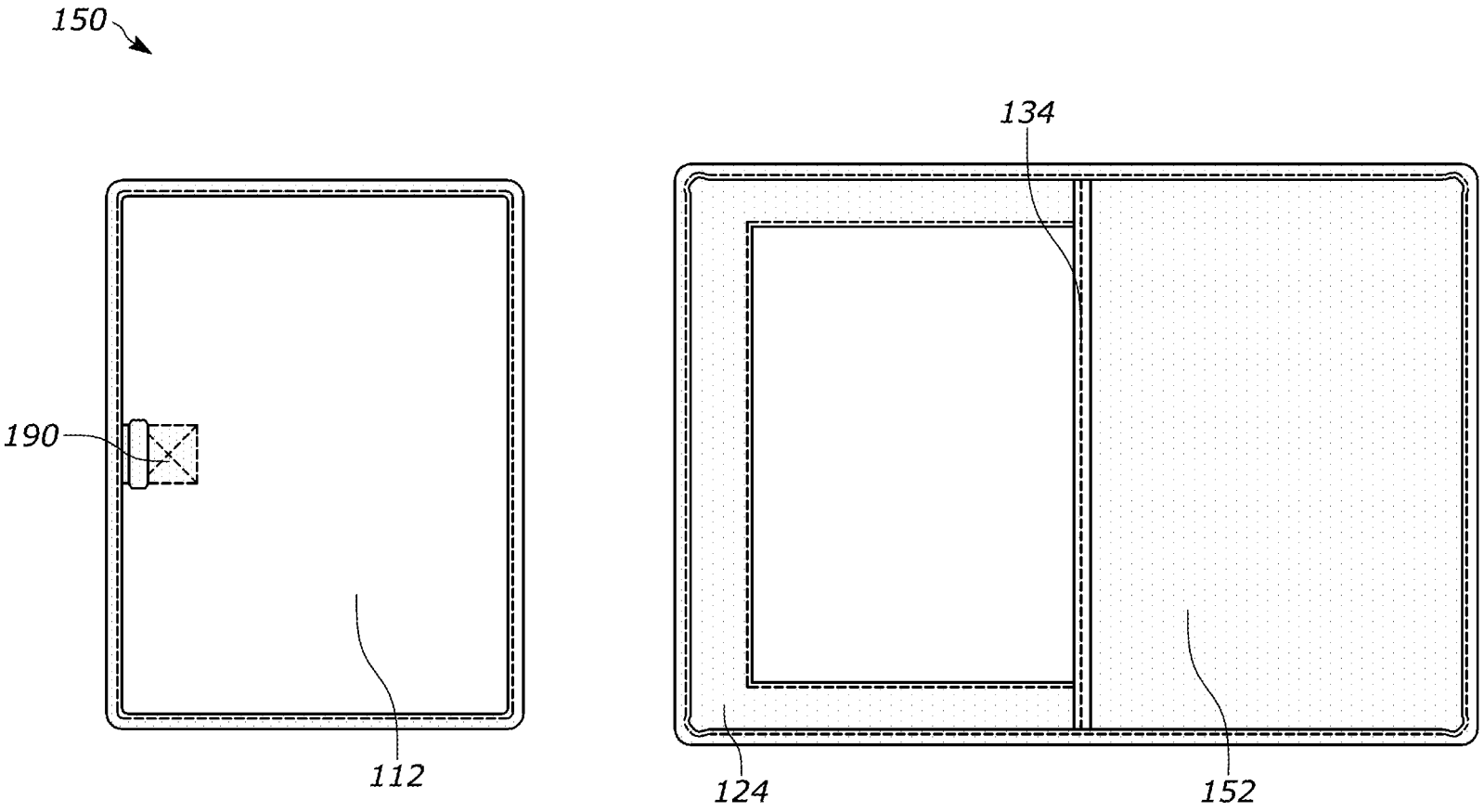
FIG. 42 depicts a top view of an alternative top panel that can be used in place of the top panel in the thirteenth embodiment shown in FIG. 29, the top panel comprising a slide lid, gusset, pocket and opening, with the slide lid depicted fully removed from the top panel.

FIG. 42 depicts a top view of an embodiment of the tote 100 with a top panel 150 comprising a slide lid 112 with strap 190, a gusset 124, a pocket 152 and an opening 134 through which the slide lid 112 enters the pocket 152. The slide lid 112 is depicted fully removed from the top panel 150. The slide lid 112 may be moved into and out of the pocket 152 through the opening 134 by grabbing and pulling the strap 190 in a certain direction. In a fully closed position the slide lid 112 will sit on top of the gusset 124.

As depicted in FIGS. 43 and 44, in embodiments of the tote 100, the top panel 150 with slide lid 112 further comprises a lid apron 120 (as depicted in FIGS. 43 and 44). In the embodiment shown, the lid apron 120 extends around all four sides of the top panel 150, extending downwards from the edges of the top panel 150 to frictionally engage with the sides of the tote 100. In alternative embodiments, the lid apron 120 may extend from only a subset of the sides of the top panel 150. In some embodiments, as depicted in FIGS. 43 and 44 the lid apron may include reinforcements 122 to stiffen and provide additional structure to the top panel. In an embodiment, the top panel is hingably attached to a tote 100 and the lid apron 120 only extends from the sides of the top panel 150 that are not hingably connected. In an alternative embodiment, the lid apron 190 extends from a single side of the top panel 150. In embodiments, the lid apron 190 is removably attached to the tote 100 (e.g., by way of magnets placed in the lid apron 120 and tote 100 and/or by way of removable fasteners, such as a hook and loop fastener).

Figure 19:
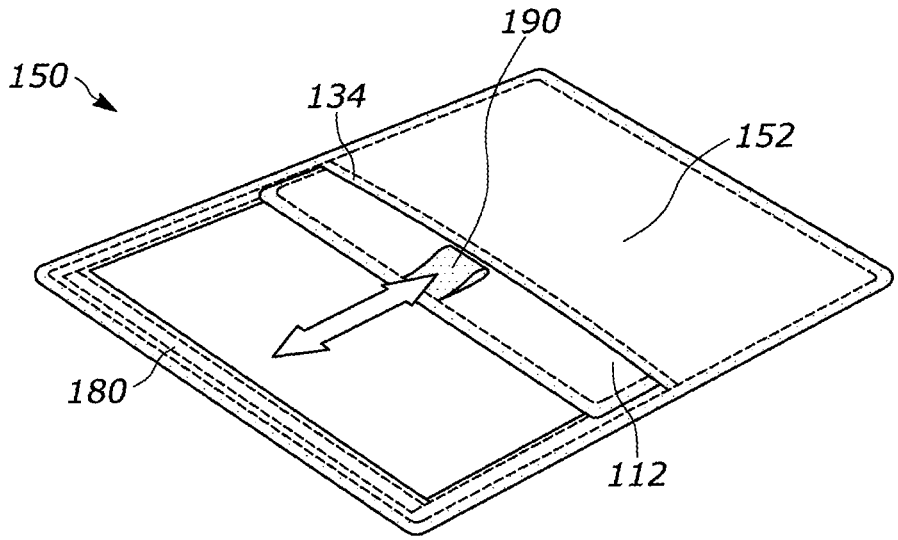
FIG. 19 is a top quarter view of a third embodiment of a top panel in accordance with the present disclosure comprising a slide lid configured to be secured in a closed position by way of one or more magnets.
Figure 20:
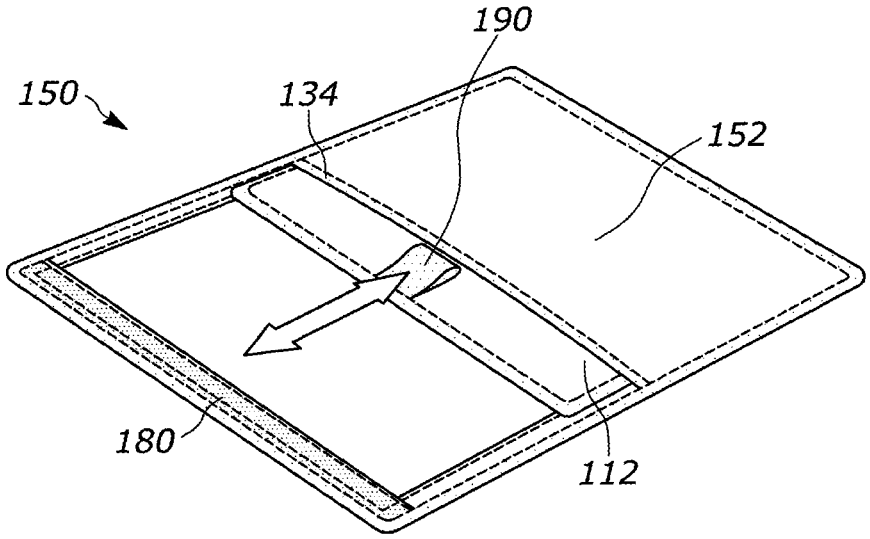
FIG. 20 is a top quarter view of a fourth embodiment of a top panel in accordance with the present disclosure comprising a slide lid configured to be secured in a closed position by way of a hook and loop fastener.
Figure 21:
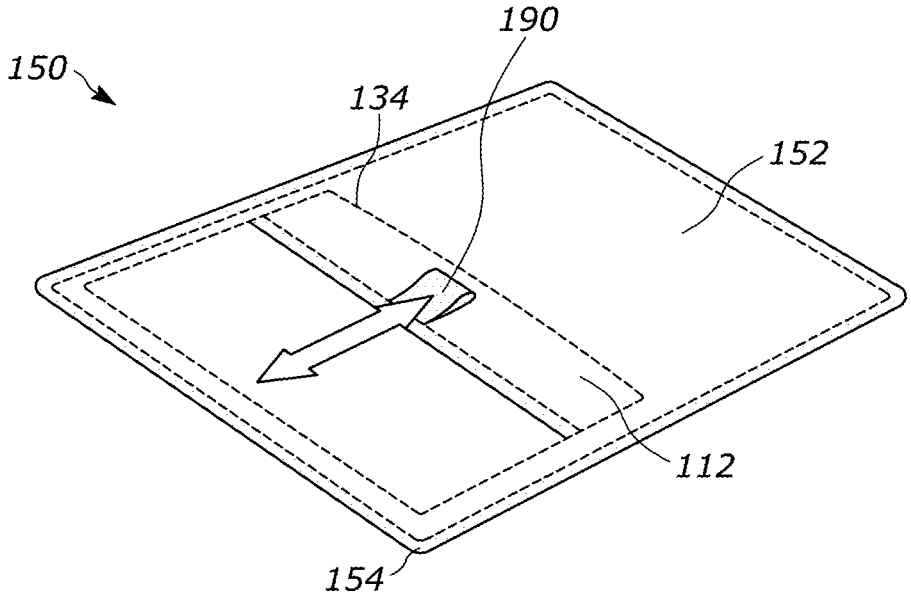
FIG. 21 is a top quarter view of a fifth embodiment of a top panel in accordance with the present disclosure comprising a slide lid that is fully enclosed by outer gussets with the slide lid depicted in a partially open position.
Figure 22:
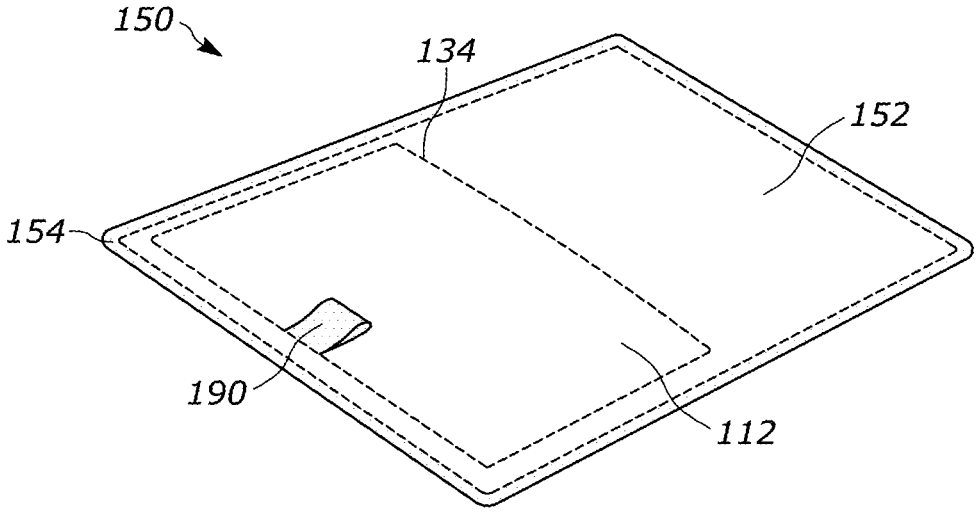
FIG. 22 depicts the embodiment of FIG. 21 wherein the slide lid is in a fully closed position and is fully enclosed by outer gussets around the perimeter of the slide lid.
Figure 23:
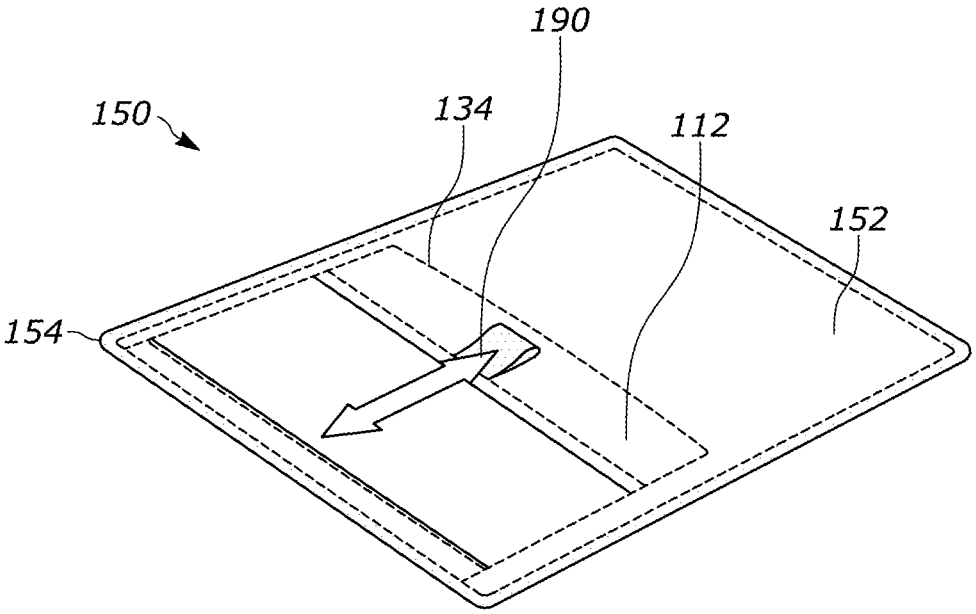
FIG. 23 is a top quarter view of a sixth embodiment of a top panel in accordance with the present disclosure comprising a partially enclosed slide lid depicted in a partially open position.
Figure 24:
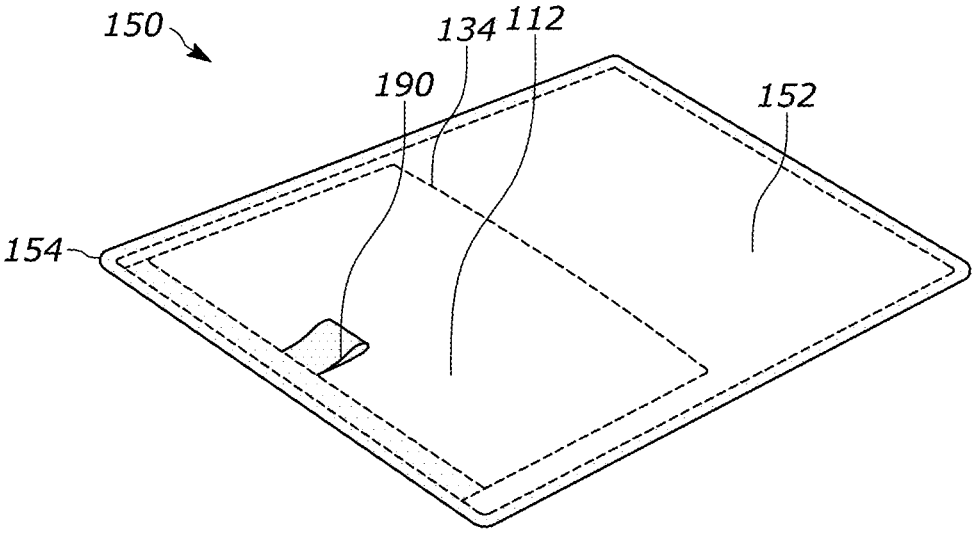
FIG. 24 depicts the embodiment of FIG. 23 with the slide lid depicted in a fully closed position such that the slide lid overlaps and covers a portion of a front gusset.
Figure 25:
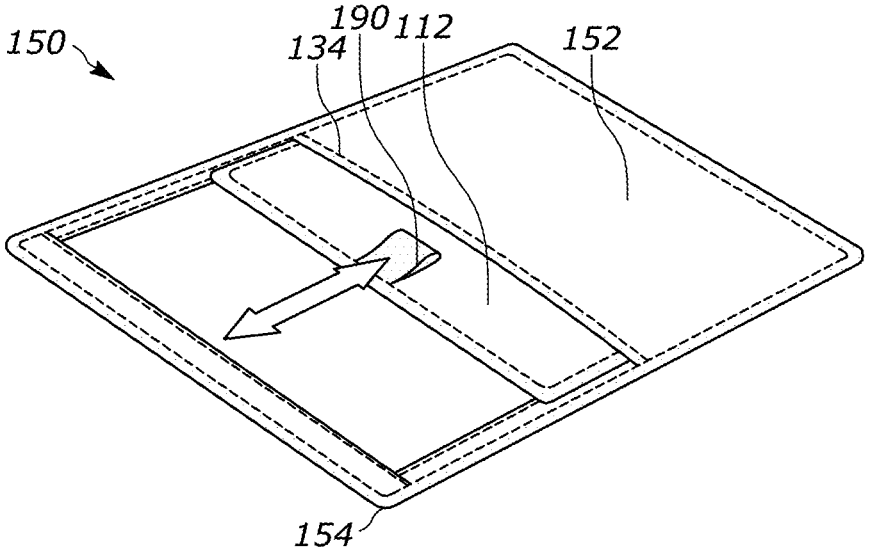
FIG. 25 is a top quarter view of a seventh embodiment of a top panel in accordance with the present disclosure comprising a partially enclosed slide lid in a partially open position wherein the slide lid is partially opened and extends over the side outer gussets.
Figure 26:
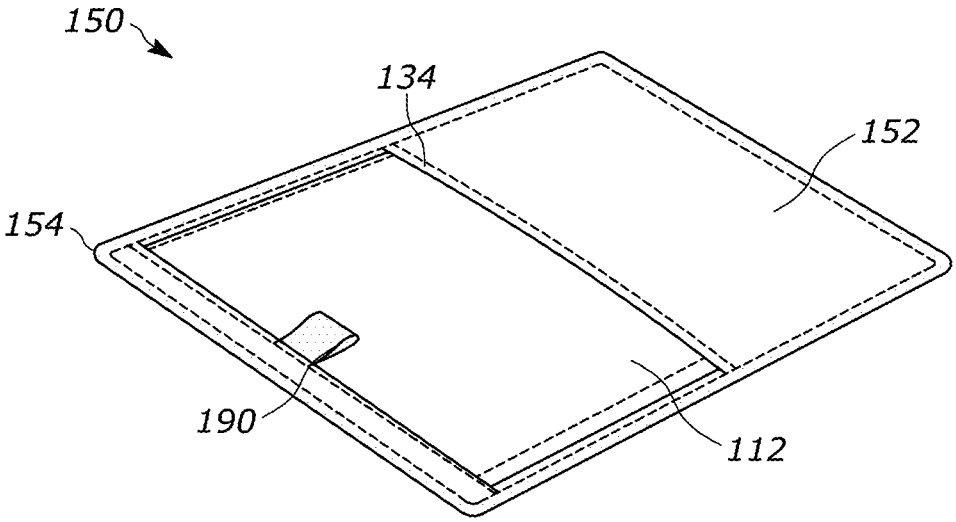
FIG. 26 depicts the embodiment of FIG. 25 with the partially enclosed slide lid in a fully closed position such that the slide lid is partially covered by the front outer gusset and extends over the side outer gussets.

In some embodiments, the slide lid 112 may have a strap 190 to aid the opening and closing of the slide lid 112. In further embodiments, the slide lid 112 may be secured to the top panel 150 when closed by hardware 180 (as depicted in FIG. 19). In other embodiments the slide lid 112 may enter a receiving pocket 152 (as depicted in FIGS. 15-26, and 42-44).

Tote with Attached Front Panel

Figure 27:
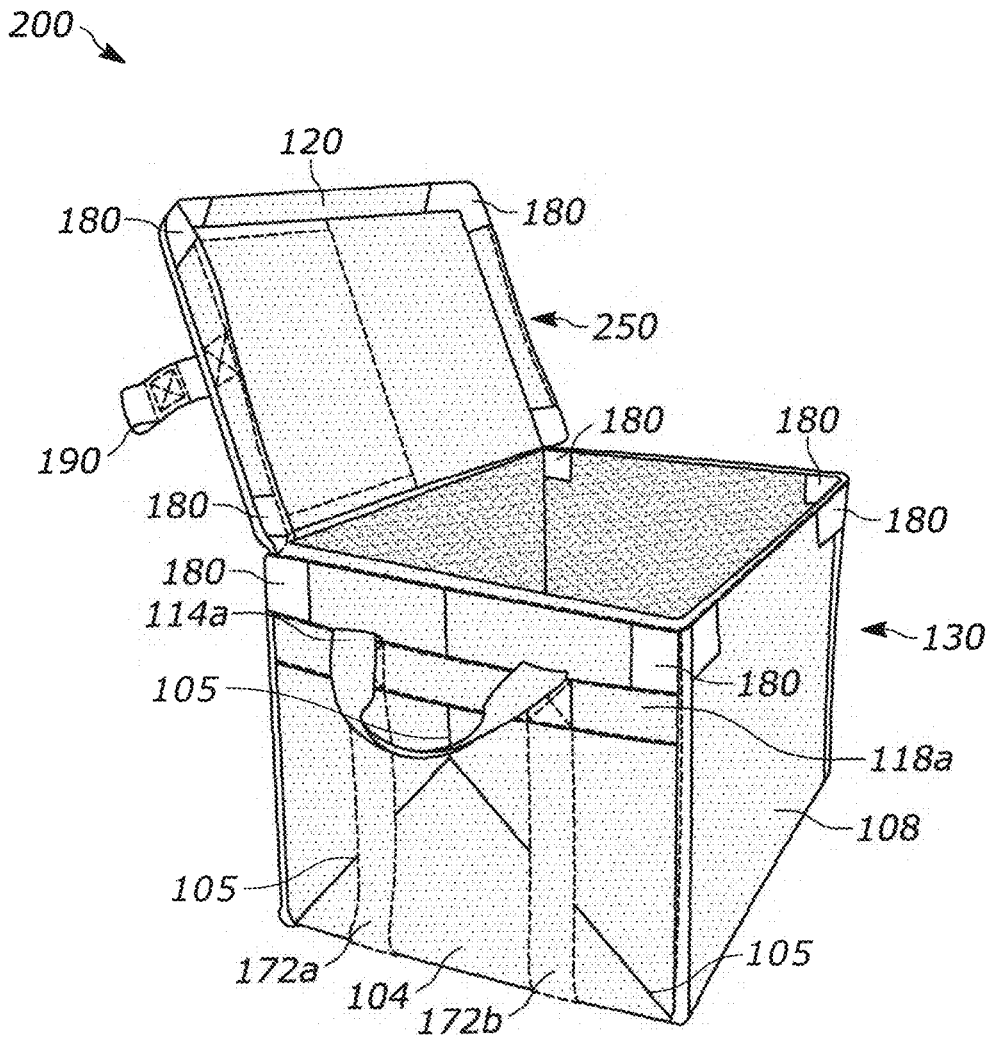
FIG. 27 depicts a twelfth embodiment of a tote in accordance with the present disclosure comprising a top panel with lid and lid apron, wherein the top panel is attached to a side panel of the tote base by stitching and remains attached at the side wall when the tote is opened and closed and is configured to be secured in a closed position by way of one or more magnets.
Figure 28:
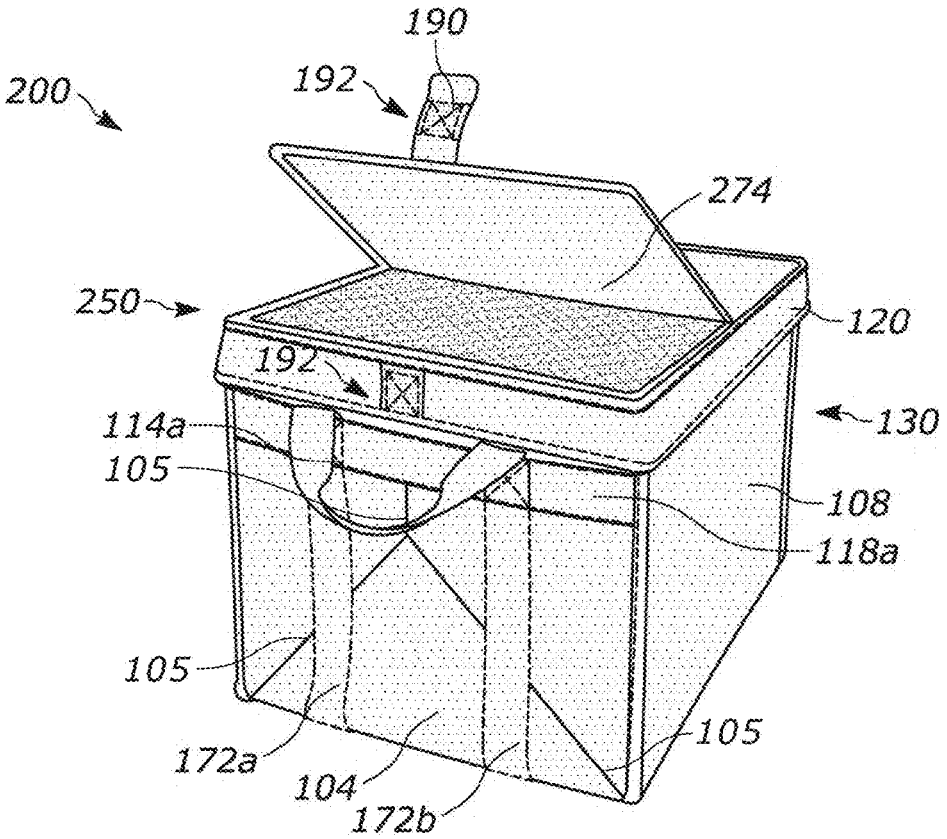
FIG. 28 depicts a thirteenth embodiment of a tote in accordance with the present disclosure comprising a top panel with folding lid and lid apron, illustrating the folding lid configured to be in a partially opened position.

The tote 200 depicted in FIG. 27 is generally the same as the tote 100 depicted in FIG. 1 except where noted. FIG. 27 depicts an embodiment of a tote 200 with a top panel 250 comprising a lid 274 and lid apron 120, that is attached to the tote base 130 on one edge of side wall 108 or 110 by stitching or another suitable means known to a person of ordinary skill in the art, such that it remains attached to the base 130 when the tote 200 is an open position. The top panel 250 may be opened by use of a strap 190. The top panel 250 is secured to the base 130 by means of one or more magnets 180. In some embodiments, the strap 190 may be a hook and loop fastener that secures the top panel 250 to the base 130. The embodiment of the tote 200 shown in FIG. 27 may also be opened by way of manipulating the lid 274. The lid 274 may be a slide lid, a flip lid, or a folding lid. The tote 200 depicted in FIG. 27 may alternatively be opened by way of manipulating the lid 274 (i.e., sliding the slide lid open or flipping the flip lid open).

Tote with Flip Lid

The tote 200 depicted in FIGS. 28-34 is generally the same as the tote 100 depicted in FIG. 1 except where noted. FIGS. 28-34 depict an embodiment of a tote 100 with a flip lid 274. In this embodiment, the top panel 250 is removable from the tote (similar to that in FIGS. 3 and 4 discussed below) and comprises a flip lid 274 and lid apron 250. The flip lid 274 may be opened by use of a strap 190. In the embodiments, the strap 190 also secures the flip lid 274 with hardware 192 to the top panel 250. The strap 190 in this embodiment aids a user in the same manner as described for the embodiment shown in FIG. 1. The top panel 250 is secured to the base 130 by means of hardware (not shown but similar in fashion to the magnets depicted in FIG. 27).

In some embodiments, the lid apron 120 of the top panel 250 has hardware 180 which secures the lid 250 to the tote base 130.

Tote with Removable Lid

Figure 3:
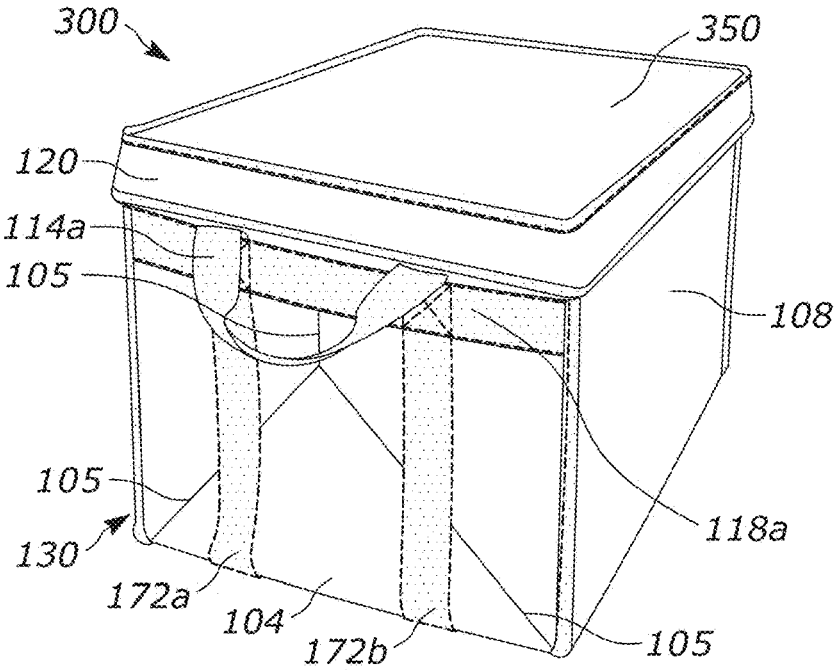
FIG. 3 is a front quarter view of a third embodiment of a tote in accordance with the present disclosure comprising a detachable top panel and lid apron.
Figure 4:
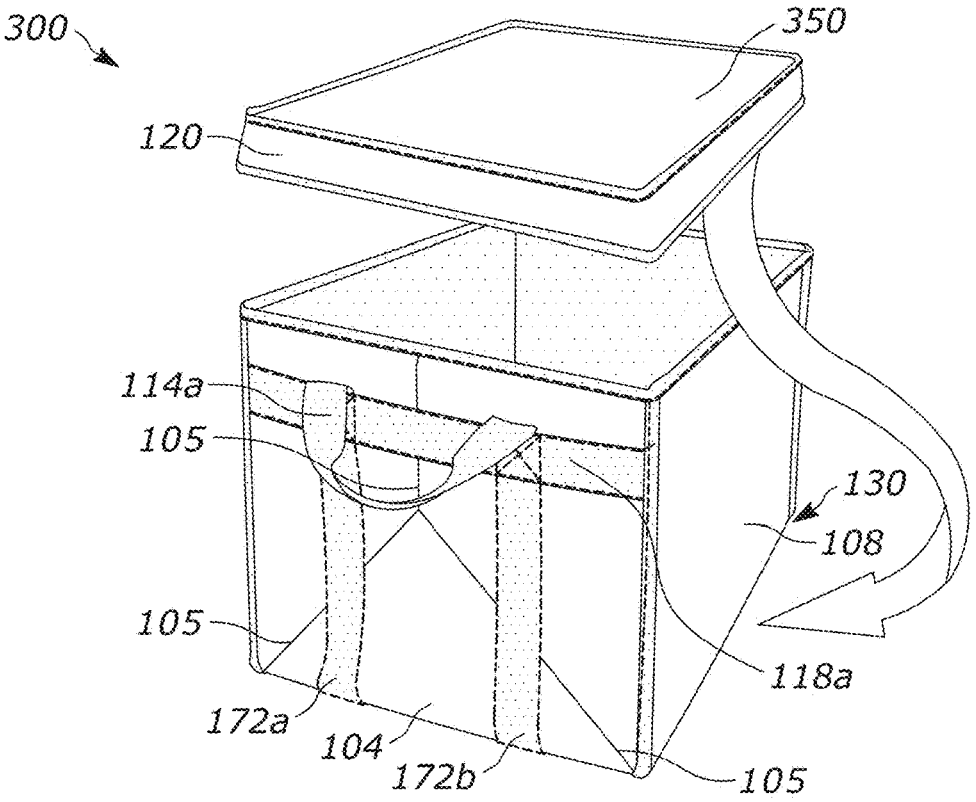
FIG. 4 depicts the third embodiment of FIG. 3 with the top panel removed from the tote body, and illustrating a method for placing and securing the top panel under the tote body.

The tote 300 depicted in FIGS. 3 and 4 is generally the same as the tote 100 depicted in FIG. 1 except where noted. FIGS. 3 and 4 illustrate an embodiment where the tote 300 has a top panel 350 with a lid apron 120. The lid apron 120 extends around the top panel 350 when the top panel 350 is placed on the tote base 130. The tote 300 may easily be stacked by placing the top panel 350 on top of the tote base 130 and subsequently placing a tote 300 on top of another so that the top panel 350 of the bottom tote 300 is in contact with the base panel 102 of the top tote 300. Multiple totes 300 may be stacked in this manner. FIG. 4 also illustrates that the top panel 350 may be placed on the tote base 130 of the tote 300 when the top panel 350 is not in use. This is beneficial as the top panel 350 does not take up extra space when it is not in use.

Tote with Removeable Lid and Gusset

Figure 5:
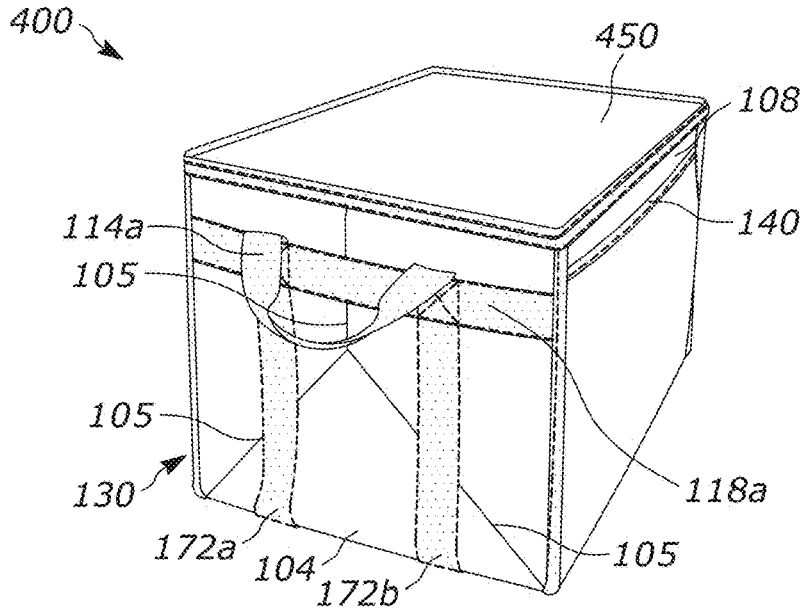
FIG. 5 is a front quarter view of a fourth embodiment of a tote in accordance with the present disclosure comprising a top panel that is detachable from the tote body in a closed position and a side pocket to store the top panel when removed.
Figure 6:
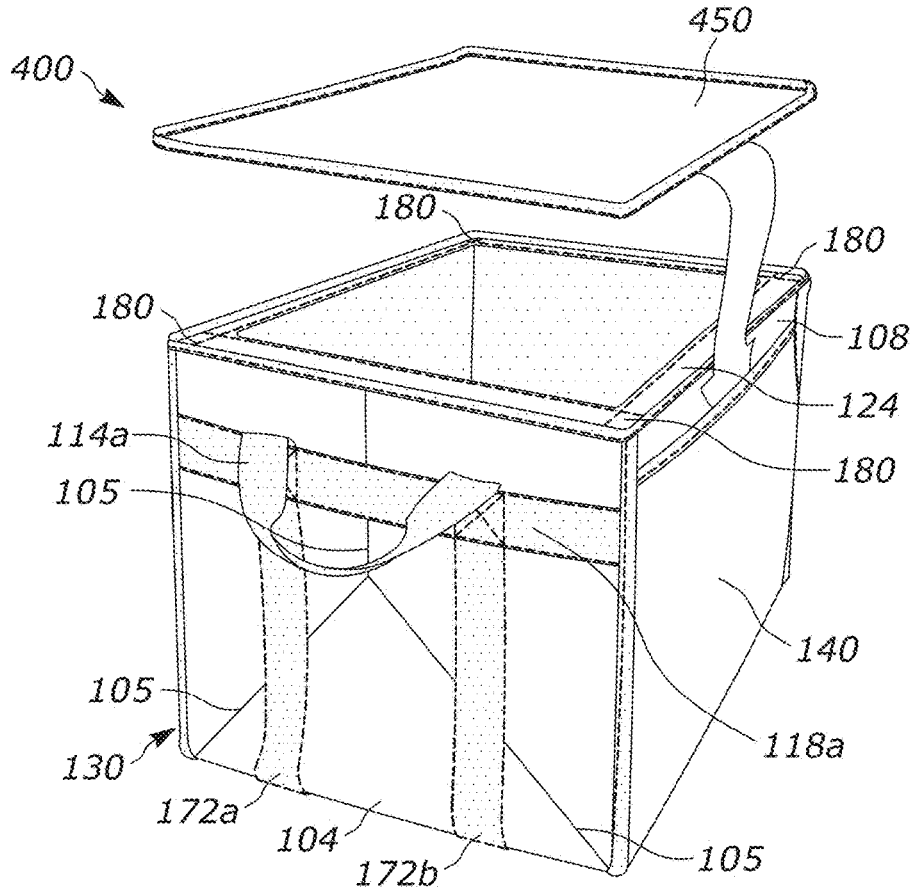
FIG. 6 depicts the fourth embodiment of FIG. 5 with the top panel fully removed, illustrating a gusset and a plurality of hardware for supporting and securing the top panel when in a closed position and further illustrating a method for placing and securing the top panel in the side pocket.

The tote 400 depicted in FIGS. 5 and 6 is generally the same as the tote 100 depicted in FIG. 1 except where noted. As shown in FIGS. 5 and 6, a tote 400 has a top panel 450 that may be not permanently affixed to the tote base 130. In some embodiments, the top panel 450 can be secured to the tote base 130 with magnets 180. The magnets 180 being in each corner of the top panel 450 and in a receiving location in the tote base 130 A lid gusset 124 may be used in some embodiments. A lid gusset 124 is beneficial to improve the seal between the top panel and the tote base 130. The top panel 450 embodiment depicted in FIGS. 5 and 6 may be placed inside a lid pocket 140 when not in use. The lid pocket 140 may be located on the side wall 108 or 110 or the base panel 102. The lid side pocket 140 is beneficial because it allows the top panel to be stored when the top panel 450 is not in use.

Tote with Folding Lid and Gusset

Figure 7:
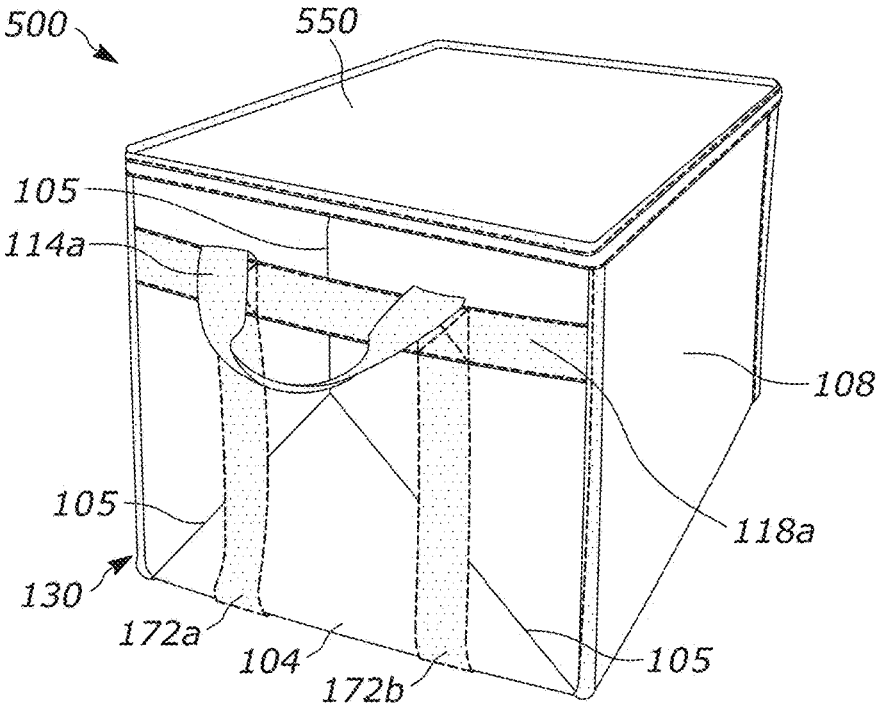
FIG. 7 is a front quarter view of a fifth embodiment of a tote in accordance with the present disclosure comprising a top panel movably attached to a side panel.
Figure 8:
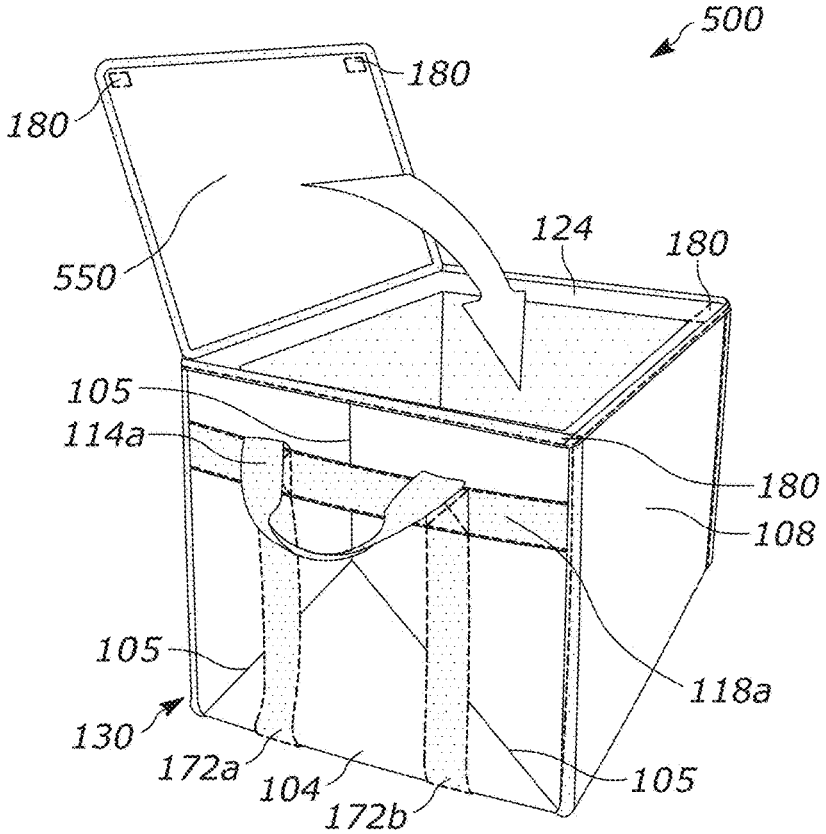
FIG. 8 is a front quarter view of the fifth embodiment shown in FIG. 7, wherein the top panel is depicted in an open position illustrating a lid gusset and hardware for securing and supporting the top panel in a closed position.

The tote 500 depicted in FIGS. 7 and 8 is generally the same as the tote 100 depicted in FIG. 1, except where noted. As shown in FIGS. 7 and 8, a tote 500 with a lid 550 may be affixed to the base of the tote 500 with a flexible hinge 578 at one end of one side wall 108 or 110. The opposite side wall 108 or 110 may contain hardware 180 in the form of magnets at the top of the side wall 108 or 110. In some embodiments, corresponding hardware 180 is placed in the corners of the top panel 550 such that the magnets 180 in the lid 550 align with the magnets 180 in the side wall. The embodiment further depicts a gusset 124. The gusset extends around all sides of the top of tote base 130 and along the topmost portion of the front wall 104, the side walls 108, 110, and the rear wall 106. The benefit of the gusset 124 in this position is that when the top panel 550 is in a closed position, the hardware 180 secures the top panel 550 to the gusset 124, thereby retaining heat or cold within the tote 500.

Tote with a Removable Lid with Webbing Sleeve

Figure 9:
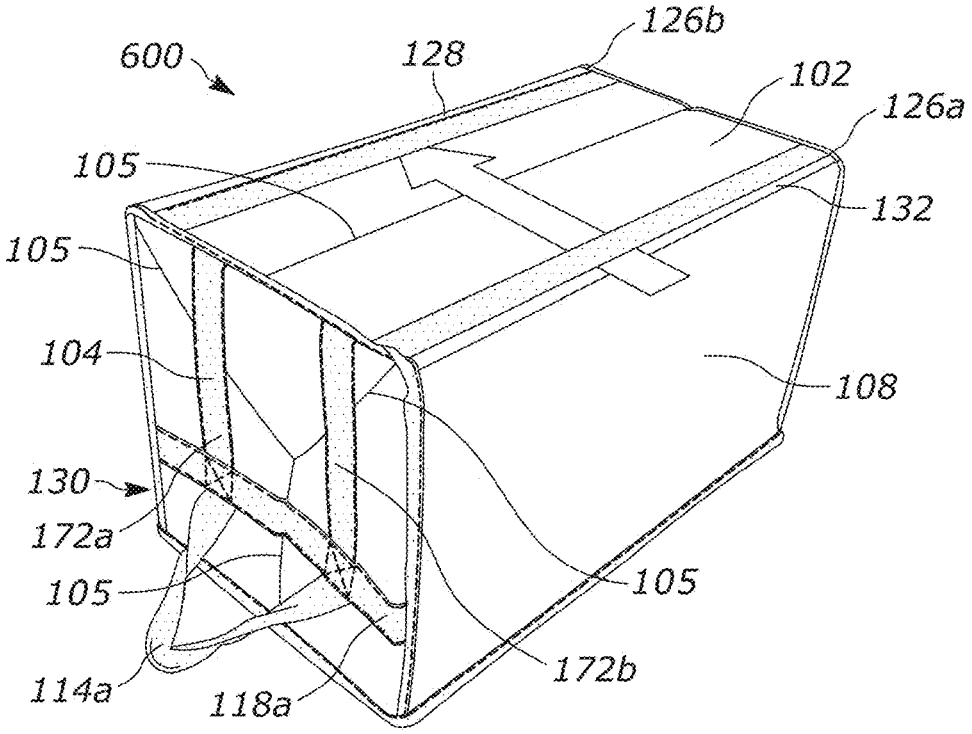
FIG. 9 is a bottom quarter view of a sixth embodiment of a tote in accordance with the present disclosure comprising a pair of longitudinally oriented webbing straps on a bottom panel configured to secure a removable top panel in a stored position adjacent to the bottom panel and further stiffen the tote base.
Figure 11:
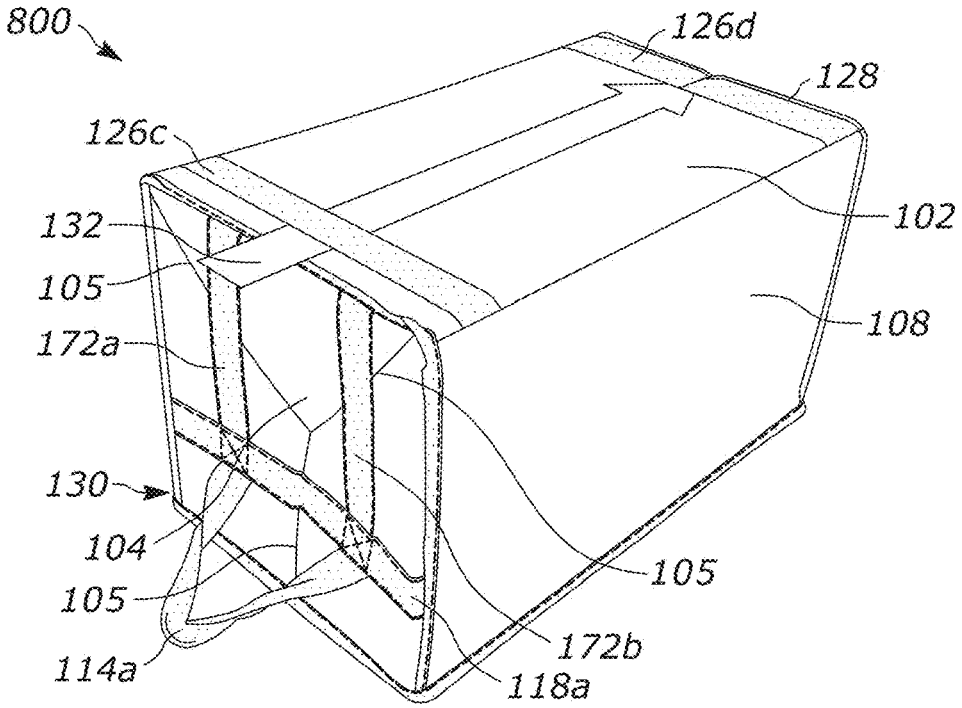
FIG. 11 is a bottom quarter view of an eighth embodiment of a tote in accordance with the present disclosure comprising a pair of laterally extending webbing straps configured to secure a removable top panel in a stored position adjacent to the bottom panel and further stiffen the tote base.

The tote 600 depicted in FIGS. 9 and 11 is generally the same as the tote 100 depicted in FIG. 1, except where noted. As shown by FIG. 9, a tote 600 with a top panel with lid (not shown) where the lid (not shown) may be stored on the bottom panel 102. In these embodiments, the lid (not shown) is held to the tote base 130 by a pair of longitudinal straps **126*a* and 126*b* and the straps 126*a* and 126*b* may be webbing straps. The straps 126*a* and 126*b* extend along the base panel 102 from the front panel 104 to the back panel 106. The lid (not shown) is slid between the straps 126*a* and 126*b* and the base panel 102 of the tote 600 through the opening. In this manner the lid (not shown) is secured. One long edge of a strap 126*b* is connected to the base panel 102 of the tote 600 by means of sleeve stitching 128. The sleeve stitching 128 prevents a lid (not shown) from being pushed through the strap 126***b*. In this manner, the lid (not shown) can only enter the straps 126*a* and 126*b* through the opening 132.

In an alternative embodiment, depicted in FIG. 11, a tote 800 with a lid (not shown) where the lid may be secured to the bottom panel 102 with a pair of horizontal straps 126*c* and 126*d* which span from one side wall panel 108 to the other side wall panel 110 (not shown), and the straps 126*a* and 126*b* may be webbing straps. In this embodiment, the lid (not shown) can be secured to the base panel 102 of the tote 800 by sliding it through the straps 126*c* and 126*d*. The straps 126*c* and 126*d* extend along the base panel 102 from the side panel 108 to the side panel 110. One long edge of a strap 126*d* is connected to the base panel 102 of the tote 800 by means of sleeve stitching 128. The sleeve stitching 128 prevents a lid (not shown) from being pushed through the strap 126*d*. In this manner, the lid (not shown) can only enter the straps 126*c* and 126*d* through the opening 132.

Tote with a Removable Lid with Pocket

Figure 10:
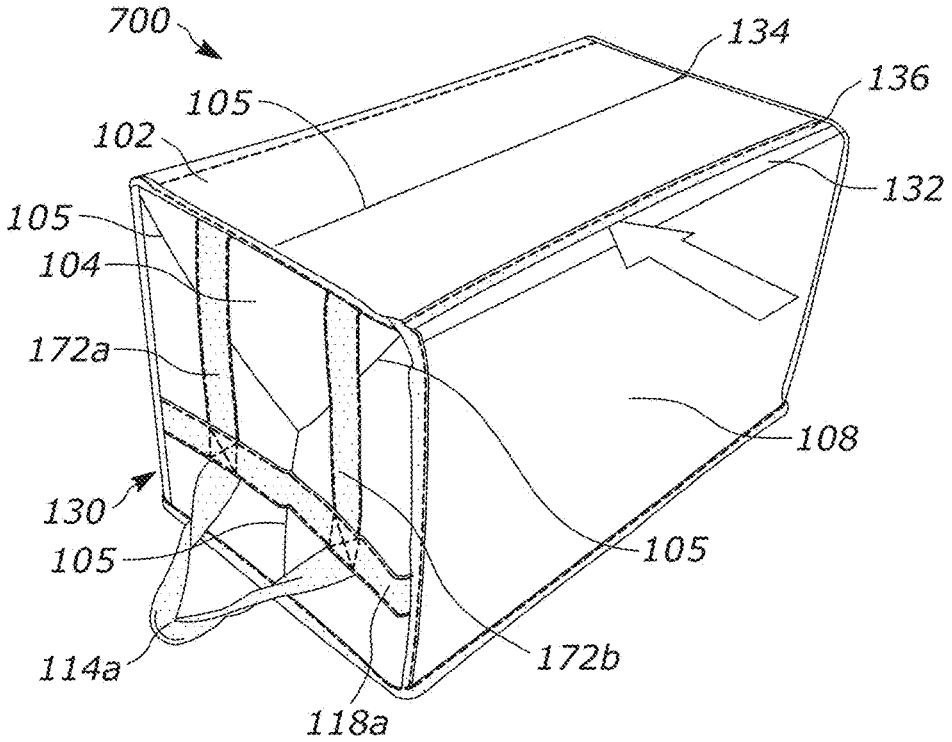
FIG. 10 is bottom quarter view of a seventh embodiment of a tote in accordance with the present disclosure comprising a side-oriented bottom pocket configured to secure a removable top panel in a stored position adjacent to the bottom panel and further stiffen the tote base.
Figure 12:
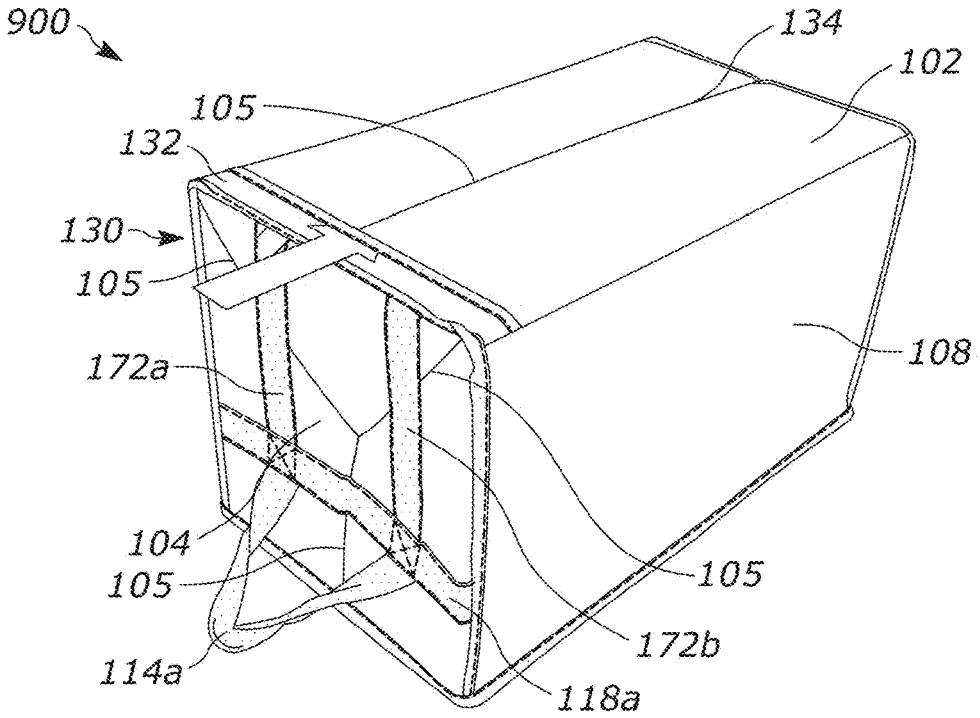
FIG. 12 is a bottom quarter view of a ninth embodiment of a tote in accordance with the present disclosure comprising a front-oriented bottom pocket configured to secure a removable top panel in a stored position adjacent to the bottom panel and further stiffen the tote base.

The tote 700 depicted in FIGS. 10 and 12 is generally the same as the tote 100 depicted in FIG. 1, except where noted. As shown in FIG. 10, the base panel 102 comprises a pocket 134. The pocket may be used to store the lid (not shown) on the base panel 102 of the tote 700. In the embodiment depicted in FIG. 10, the pocket 134 is along the side wall 108 and is sealed along the opposite side wall 110. In this manner, the lid (not shown) can only enter the pocket 134 through the opening 132. This embodiment allows the lid to be stored on the tote 700 when not in use without taking up additional space.

In an alternative embodiment depicted in FIG. 12, a tote 900 has a pocket 134 on the base panel 102 that is accessible via an opening 132 at the base of the front wall panel 104. This embodiment offers additional benefits when the tote 700 is stored in a manner where only the front wall panel 104 is accessible. In this embodiment, the lid (not shown) may still be stored in the pocket 134 because the opening 132 will still be accessible.

Tote with a Removable Lid Stowed Via Mounted Hardware

Figure 13:
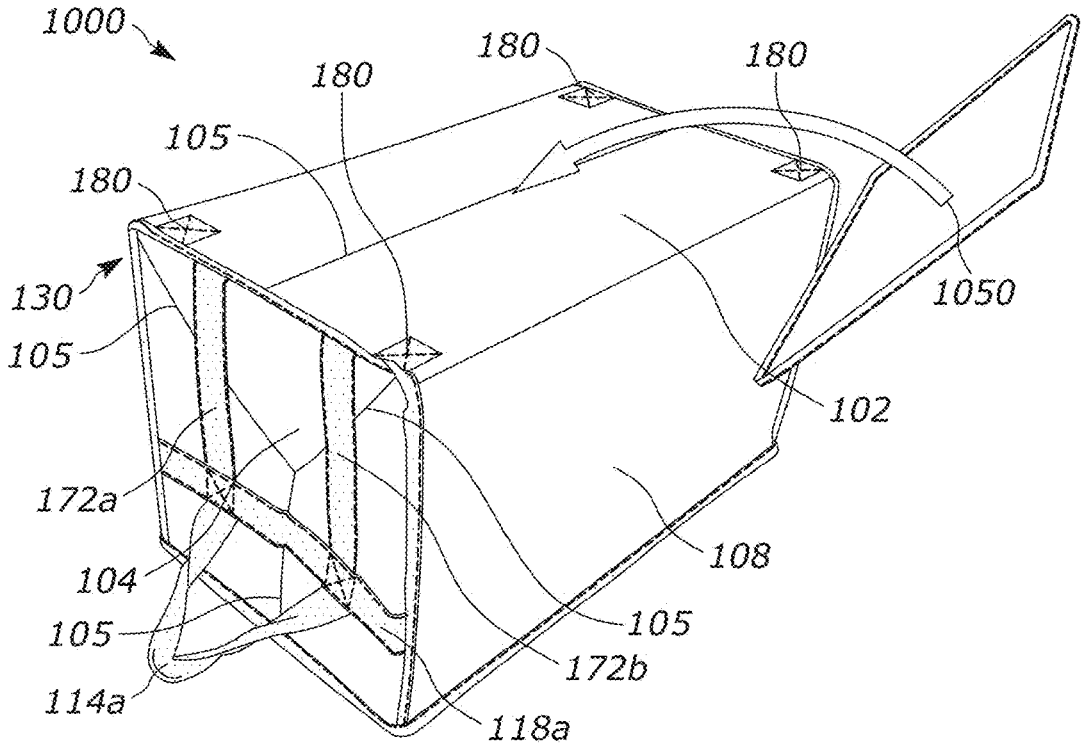
FIG. 13 is a bottom quarter view of a tenth embodiment of a tote in accordance with the present disclosure comprising attachment hardware configured to secure a removable top panel in a stored position adjacent to the bottom panel and further stiffen the tote base.
Figure 14:
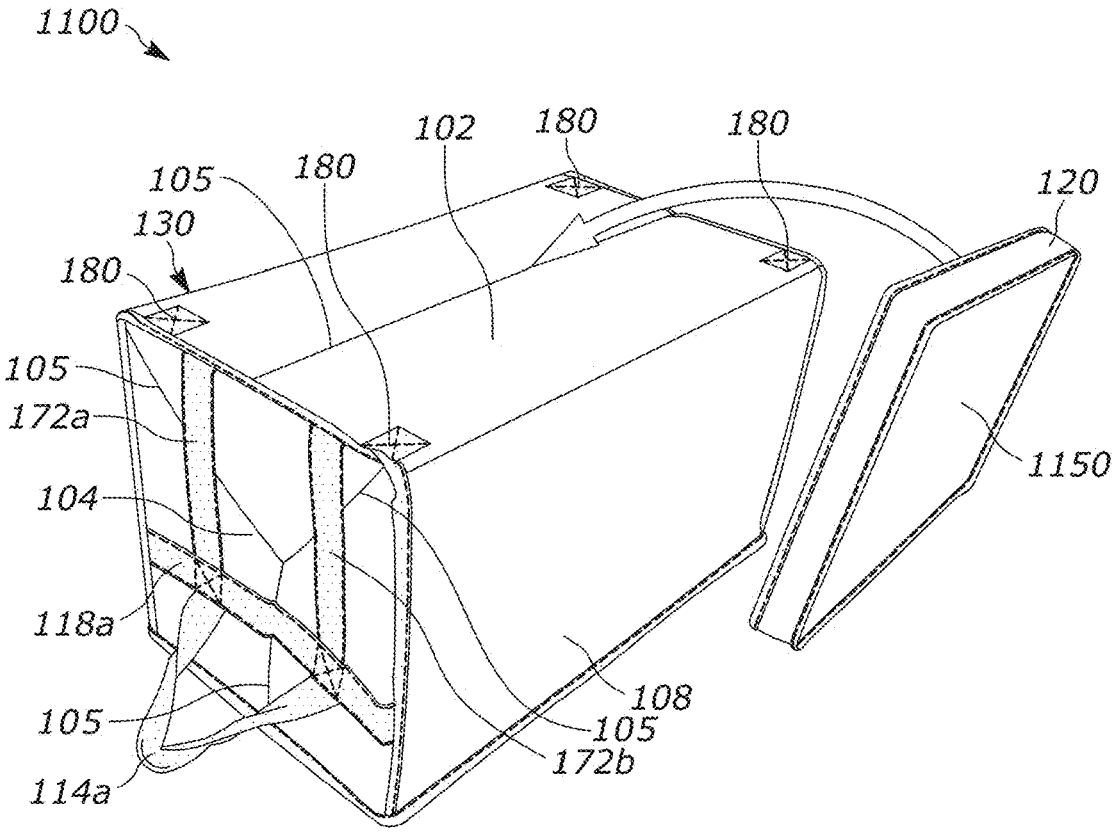
FIG. 14 is a bottom quarter view of an eleventh embodiment of a tote in accordance with the present disclosure comprising attachment hardware configured to secure a removable top panel having a lid apron in a stored position adjacent to the bottom panel and further stiffen the tote base.

The tote 1000 depicted in FIGS. 13 and 14 is generally the same as the tote 100 depicted in FIG. 1, except where noted. In some embodiments, as depicted in FIGS. 13 and 14, the tote 1000 may have a detachable top panel 1050 that is flat (as shown in FIG. 13), or a top panel 1150 with a lid apron 120 (as shown by FIG. 14) that may be secured to the base panel 102 with hardware 180. As would be understood by one of ordinary skill in the art, the hardware 180 could be a hook and loops. A top panel 1050 without a lid apron 120 may be beneficial in some circumstances because it will be easier to manipulate and store due to its smaller profile. In other circumstances, a top panel 1150 with a lid apron 120 may be beneficial because it will secure to the tote base 130 more readily. More generally, a top panel which can be stored to the base of the embodiments will provide additional support to the structure of the embodiments and not take additional space.

It is understood that the preceding is merely a detailed description of some examples and embodiments of the present invention and that numerous changes to the disclosed embodiments may be made in accordance with the disclosure made herein without departing from the spirit or scope of the invention. The preceding description, therefore, is not meant to limit the scope of the invention but to provide sufficient disclosure to allow one of ordinary skill in the art to practice the invention without undue burden. It is further understood that the scope of the present invention fully encompasses other embodiments that may become obvious to those skilled in the art and that the scope of the present invention is accordingly limited by nothing other than the appended claims.

What is claimed is:

1. A container comprising:

a base comprising a plurality of panels cooperatively assembled to define an interior cavity accessible via an opening, the plurality of panels comprising at least a base panel, a front panel opposing a rear panel, and a pair of opposing side panels;

a top panel movable between a closed position in which the top panel obstructs the opening and one or more open positions in which the top panel does not obstruct the opening;

wherein the container is configured to fold into a collapsed configuration by moving the top panel into a first open position of the one or more open positions, folding at least a central portion of each of the front panel and the rear panel into the interior cavity along one or more fold lines disposed thereon, and folding at least a top portion of each of the pair of opposing side panels inward; and a pocket configured to secure the top panel in at least a second open position of the one or more open positions.

2. The container of claim 1, wherein the top panel comprises a movable panel configured to move between a first position in which the opening is obstructed and a second position in which at least a portion of the opening is not obstructed.

3. The container of claim 2, wherein an inner gusset extends inward from at least a portion of the top panel surrounding the movable panel below the movable panel when the movable panel is in the first position.

4. The container of claim 2, wherein an outer gusset extends inward from at least a portion of the top panel surrounding the movable panel above the movable panel when the movable panel is in the first position.

5. The container of claim 2, wherein the top panel comprises a pocket configured to hold the movable panel in the second position and one or more hardware configured to removably secure the movable panel in the first position.

6. The container of claim 1, wherein the top panel is foldably secured to a respective one of the opposing side panels.

7. The container of claim 1, wherein a body gusset extends partially into the opening from the side panels, the front panel, and the rear panel.

8. The container of claim 1, wherein the top panel further comprises a lid apron extending from a perimeter of the top panel partially into the opening.

9. The container of claim 1, further comprising one or more straps configured to secure the top panel in at least a second open position of the one or more open positions.

10. The container of claim 1, wherein the top panel is configured to be removably secured to the base panel in at least a second open position of the one or more open positions by way of one or more fasteners.

11. The container of claim 1, wherein at least one of the plurality of panels comprises an interior layer proximate the cavity, an exterior layer, and a layer of insulation located therebetween.

12. The container of claim 11, wherein said at least one of the plurality of panels further comprises a gel and a stiffener.

13. The container of claim 12, wherein with the top panel in the first open position, the top panel is spaced apart from the base.

14. The container of claim 11, wherein the exterior layer comprises an aluminizing material.

15. The container of claim 11, wherein said at least one of the plurality of panels further comprises an aluminum radiant barrier.

16. The container of claim 11, wherein the top panel comprises at least one gel pack.

17. The container of claim 11, wherein the top panel comprises a stiffener.

18. The container of claim 17, wherein the top panel is configured to be secured proximate the base panel when in a second open position of the one or more open positions and wherein the top panel prevents the container from folding into the collapsed configuration when in the second open position.

* * * * *